US010617227B2

(12) United States Patent
Oakes

(10) Patent No.: US 10,617,227 B2
(45) Date of Patent: Apr. 14, 2020

(54) CUTLERY DISPENSER AND RELATED METHODS

(71) Applicant: GPCP IP HOLDINGS LLC, Atlanta, GA (US)

(72) Inventor: Shawn A. Oakes, Ripon, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 15/914,236

(22) Filed: Mar. 7, 2018

(65) Prior Publication Data

US 2018/0192790 A1 Jul. 12, 2018

Related U.S. Application Data

(62) Division of application No. 14/336,701, filed on Jul. 21, 2014, now Pat. No. 9,943,176.
(Continued)

(51) Int. Cl.

| | |
|---|---|
| ***A47F 1/12*** | (2006.01) |
| ***B65D 75/46*** | (2006.01) |
| ***A47F 1/04*** | (2006.01) |
| ***B65D 83/00*** | (2006.01) |
| ***B65D 75/42*** | (2006.01) |
| ***B65D 5/52*** | (2006.01) |

(52) U.S. Cl.
CPC ..... *A47F 1/12* (2013.01); *A47F 1/04* (2013.01); *B65D 5/526* (2013.01); *B65D 75/42* (2013.01); *B65D 75/46* (2013.01); *B65D 83/00* (2013.01)

(58) Field of Classification Search
CPC ..... A47F 1/04; B65D 5/526; B65D 75/42; B65D 75/46; B65D 83/00
USPC ..... 221/1, 26, 32; 206/56; 220/666
See application file for complete search history.

(56) References Cited

U.S. PATENT DOCUMENTS

| | | | |
|---|---|---|---|
| 46,832 | A | 3/1865 | Thorne |
| 592,105 | A | 10/1897 | Barnes |

(Continued)

FOREIGN PATENT DOCUMENTS

| | | | |
|---|---|---|---|
| CA | 2545745 | A1 | 11/2006 |
| CN | 2865478 | A1 | 2/2007 |

(Continued)

OTHER PUBLICATIONS

European Search Report for 060009258.2, dated Jul. 24, 2006, five pages, Munich, Germany.

(Continued)

*Primary Examiner* — Rakesh Kumar

(57) ABSTRACT

The present disclosure provides a cutlery dispenser for dispensing wrapped cutlery. The cutlery dispenser may include a case configured to expand from a compact configuration into an expanded configuration. The cutlery dispenser also may include a wrapped cutlery band disposed within the case and configured to be dispensed therefrom. The present disclosure also provides a method for dispensing wrapped cutlery. The method may include the step of providing a cutlery dispenser including a case and a wrapped cutlery band disposed within the case. The method also may include the step of expanding the case from a compact configuration into an expanded configuration. The method further may include the step of dispensing at least a portion of the wrapped cutlery band from the case.

17 Claims, 14 Drawing Sheets

Related U.S. Application Data

(60) Provisional application No. 61/858,194, filed on Jul. 25, 2013.

(56) References Cited

U.S. PATENT DOCUMENTS

D32,913 S 7/1900 Graf
703,718 A 7/1902 Cammann
716,058 A 12/1902 Laing et al.
925,485 A 6/1909 Lafler
999,837 A 8/1911 Morris et al.
1,053,387 A 2/1913 Hawley
1,146,447 A 7/1915 Prommel
1,182,793 A 5/1916 Richardson
1,259,927 A 3/1918 Swift
1,261,835 A 4/1918 Martin
1,353,109 A 9/1920 Carr
1,355,583 A 10/1920 Zeidler et al.
1,482,071 A 1/1924 Duff et al.
1,497,585 A 6/1924 Poole
1,504,098 A 8/1924 Cathey
1,546,077 A 7/1925 Hunter et al.
1,547,151 A 7/1925 Watling
1,560,938 A 11/1925 Lund
1,577,302 A 3/1926 Schultz
1,610,001 A 12/1926 Foster
1,635,386 A 7/1927 Pierson
1,645,771 A 10/1927 Pillsbury
1,675,510 A 7/1928 Nolan
1,767,634 A 6/1930 Weiss
1,821,377 A 9/1931 Cusick
1,886,378 A 11/1932 Dearsley
1,936,057 A 11/1933 Hodge
2,052,505 A 8/1936 Vetrosky
2,053,828 A 9/1936 Stephen
2,078,984 A 5/1937 Williamson
2,089,378 A 8/1937 Jenkin
2,110,189 A 3/1938 Zeidler
2,141,684 A 12/1938 Diemer
2,149,098 A 2/1939 Phinney
2,149,099 A 2/1939 Phinney et al.
2,160,374 A 5/1939 Veillette
2,184,029 A 12/1939 Wicklund
2,188,573 A 1/1940 Longo
D119,760 S 4/1940 Kopp
2,207,528 A 7/1940 Witt
2,223,347 A 12/1940 Axthelm
2,239,196 A 4/1941 Lunvik
2,246,852 A 6/1941 Kale
2,260,596 A 10/1941 Young
2,268,873 A 1/1942 Hopkins et al.
2,328,486 A 8/1943 Painter
2,340,561 A 2/1944 Renfro
2,401,534 A 6/1946 Welch
2,421,782 A 6/1947 Gibbs et al.
2,427,321 A 9/1947 Casey et al.
2,431,121 A 11/1947 Hunter
2,433,736 A 12/1947 Carew
2,445,026 A 7/1948 Louis
2,472,051 A 5/1949 Testi
2,497,718 A 2/1950 Earley et al.
2,503,741 A 4/1950 Johnson
2,526,136 A 10/1950 Holzknecht
2,571,668 A 10/1951 Booth et al.
2,577,344 A 12/1951 Masure
2,624,093 A 1/1953 Hatch et al.
2,635,025 A 4/1953 Ziska
2,646,874 A 7/1953 Testi
2,651,093 A 9/1953 Lynch
2,671,555 A 3/1954 Shnitzler
2,692,691 A 10/1954 Harriss et al.
2,695,125 A 11/1954 Bowen
2,752,678 A 7/1956 Welch
2,758,710 A 8/1956 Arens
2,771,214 A 11/1956 Lefebvre
2,800,013 A 7/1957 Cesar
2,806,634 A 9/1957 Baumgartner
2,824,369 A 2/1958 Welch
2,843,909 A 7/1958 Eilertsen
2,845,679 A 8/1958 Baruch
2,857,645 A 10/1958 Vogelsang
2,868,344 A 1/1959 Shields
2,870,505 A 1/1959 Frederick
2,877,490 A 3/1959 Greniger
2,877,926 A 3/1959 Abbe
2,880,907 A 4/1959 Mainers
2,881,247 A 4/1959 Levine et al.
2,887,247 A 5/1959 Williams
2,889,076 A 6/1959 Schie
2,907,512 A 10/1959 Leone
2,911,127 A 11/1959 Driss et al.
2,924,357 A 2/1960 Kingsley et al.
2,946,431 A 7/1960 Nissen
2,946,481 A 7/1960 Carew
2,953,170 A 9/1960 Bush
2,954,948 A 10/1960 Johnson
2,965,262 A 12/1960 Du Bois
3,021,919 A 2/1962 Peters
3,037,257 A 6/1962 Girodet
3,052,006 A 9/1962 Jonas
3,083,877 A * 4/1963 Gash ..... B65D 1/0292 222/107
3,083,879 A 4/1963 Coleman
3,095,114 A 6/1963 Tobias
3,100,842 A 8/1963 Tellefsen
3,114,475 A 12/1963 Etes
3,115,989 A 12/1963 Strang
3,116,152 A 12/1963 Smith
3,132,765 A 5/1964 Florendo
3,146,908 A 9/1964 Perri et al.
3,163,327 A 12/1964 Maxwell
3,180,489 A 4/1965 McGinn
3,182,345 A 5/1965 Smith
3,191,802 A 6/1965 Walter
3,197,062 A * 7/1965 Day ..... B65D 5/0005 221/48
3,217,954 A 11/1965 Grant et al.
3,221,928 A * 12/1965 Horn ..... A47K 10/421 221/34
3,263,860 A 8/1966 Haas
3,279,652 A 10/1966 Willvonseder
3,300,087 A 1/1967 Kuypers
3,310,271 A 3/1967 King
3,313,452 A 4/1967 Katz
3,325,050 A 6/1967 Wanamaker
3,334,784 A 8/1967 Morrison
3,338,471 A 8/1967 De Good
3,371,821 A 3/1968 Abood, Jr. et al.
3,383,018 A 5/1968 Grimsley
3,400,435 A 9/1968 Akesson-Rydin
3,402,441 A 9/1968 De Woskin
3,407,927 A 10/1968 Jones
3,408,708 A 11/1968 Hawie
3,426,941 A 2/1969 Hovekamp
3,435,491 A 4/1969 Shears
3,472,421 A 10/1969 Baller
3,499,538 A 3/1970 Sherard
3,549,006 A 12/1970 Meierhoefer
3,558,006 A 1/1971 Redmond et al.
3,583,625 A 6/1971 Gero
3,587,922 A 6/1971 Oriti
3,593,908 A 7/1971 Desmond et al.
3,654,396 A 4/1972 Biezeveld
3,680,736 A 8/1972 Viessmann
3,709,403 A 1/1973 Harriman
3,710,535 A 1/1973 Walter
3,741,410 A 6/1973 Henschke et al.
3,744,866 A 7/1973 Cook
3,747,803 A 7/1973 Zoepf et al.
3,747,833 A 7/1973 Robinson
3,749,234 A 7/1973 Gero
3,786,959 A 1/1974 Greb et al.
3,851,762 A 12/1974 Liblick
3,861,563 A 1/1975 Lisbin et al.
3,862,702 A 1/1975 Johnson et al.

(56) References Cited

U.S. PATENT DOCUMENTS 3,881,599 A 5/1975 Flaherty
3,897,886 A 8/1975 Franklin
3,932,978 A 1/1976 Kinney
3,944,128 A 3/1976 Hogan
3,972,118 A 8/1976 Richard
3,987,901 A 10/1976 Dullinger
3,998,238 A 12/1976 Nigro
4,005,801 A 2/1977 Musser
4,043,203 A 8/1977 Montesi
4,048,915 A 9/1977 Martin
4,091,915 A 5/1978 Claasen
4,120,662 A 10/1978 Fosslien
4,134,519 A 1/1979 Barnett et al.
4,146,123 A 3/1979 Cottrell
4,172,520 A 10/1979 Gero
4,271,999 A 6/1981 Stravitz
4,288,003 A 9/1981 Fries, Jr.
4,308,974 A 1/1982 Jones
4,317,284 A 3/1982 Prindle
4,382,514 A 5/1983 Williams
4,387,831 A 6/1983 McNally
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
D284,442 S 7/1986 Chan
4,601,386 A 7/1986 Antonello
4,610,087 A 9/1986 Mickelson et al.
4,614,004 A 9/1986 Oshida
4,624,616 A 11/1986 Freese
4,638,921 A 1/1987 Sigl et al.
4,658,984 A 4/1987 Brunner
4,662,536 A 5/1987 Powers
4,666,037 A 5/1987 Weissman
4,666,060 A 5/1987 Bouldin
4,691,811 A 9/1987 Arakawa et al.
4,697,673 A 10/1987 Omata
4,707,251 A 11/1987 Jenkins et al.
4,715,514 A 12/1987 Vidondo
4,789,064 A 12/1988 Segal
4,793,539 A 12/1988 Haenni
4,807,753 A 2/1989 Goldstein
4,835,864 A 6/1989 Tang
4,863,033 A 9/1989 Buj
4,884,718 A 12/1989 Leahy
D305,709 S 1/1990 Blignaut
4,896,792 A 1/1990 Marchand
4,915,578 A 4/1990 Becker
4,921,106 A 5/1990 Spatafora et al.
4,930,644 A * 6/1990 Robbins, III ..... B65D 1/02 215/382
4,950,120 A 8/1990 Barnes
4,953,781 A 9/1990 Bryan
4,961,684 A 10/1990 Provan et al.
4,963,072 A 10/1990 Miley et al.
RE33,447 E 11/1990 Rosman
4,973,037 A 11/1990 Holbrook
4,986,442 A 1/1991 Hinterreiter
4,989,730 A 2/1991 Lemoine
4,995,154 A 2/1991 Bamber
5,012,927 A 5/1991 Borst
D318,600 S 7/1991 Lillelund et al.
5,054,640 A 10/1991 Tucker
5,054,649 A 10/1991 Lemaire et al.
5,064,093 A 11/1991 Davis et al.
5,080,257 A 1/1992 Carnisio et al.
5,125,566 A 6/1992 Deiger
5,127,546 A 7/1992 Chen
5,131,586 A 7/1992 Capy
5,156,266 A 10/1992 Sykora
5,161,268 A 11/1992 Harrow
5,161,691 A 11/1992 Vulliez
5,176,494 A 1/1993 Nigrelli et al.
5,191,997 A 3/1993 Squitieri
5,199,756 A 4/1993 Bartlett et al.
5,211,267 A 5/1993 Clark
D336,047 S 6/1993 Kim
5,249,705 A 10/1993 Gates
5,263,596 A 11/1993 Williams
D342,648 S 12/1993 Cautereels et al.
5,269,397 A 12/1993 Kawamoto et al.
5,288,361 A 2/1994 Konno
5,305,875 A 4/1994 Meyer
5,325,992 A 7/1994 Koller et al.
5,327,650 A 7/1994 Rojas
D351,085 S 10/1994 Schmidt
5,353,935 A 10/1994 Yeager et al.
5,364,016 A 11/1994 Capy et al.
5,379,897 A * 1/1995 Muckenfuhs ..... B65D 83/0805 206/233
5,413,317 A 5/1995 Spoerre
D362,160 S 9/1995 Brabeck et al.
5,449,054 A 9/1995 Wiese et al.
5,458,272 A 10/1995 Ward-Weber
5,460,252 A 10/1995 Kosugi et al.
5,469,688 A 11/1995 Dunbar et al.
5,479,708 A 1/1996 Thomas
5,497,863 A 3/1996 Schmidt et al.
5,509,522 A 4/1996 Laidlaw
5,518,149 A 5/1996 Lotspeich et al.
5,542,508 A 8/1996 Van Erden et al.
5,564,594 A 10/1996 Monfredo
5,579,910 A 12/1996 Bennett
5,586,685 A 12/1996 Dorner et al.
5,590,472 A 1/1997 Yaakov
5,605,208 A 2/1997 Friedrichsen et al.
5,660,252 A 8/1997 Lafon
5,762,211 A 6/1998 Ensign
5,845,403 A 12/1998 Nivin
5,853,092 A 12/1998 Goodman et al.
5,904,250 A 5/1999 De Schutter
5,921,408 A 7/1999 Groenewold et al.
5,933,918 A 8/1999 Wallays
5,950,842 A 9/1999 Baur
5,957,358 A 9/1999 Getz et al.
5,961,021 A 10/1999 Koike et al.
D420,887 S 2/2000 Chen
6,023,908 A 2/2000 Vetsch
6,023,913 A 2/2000 Gray et al.
D422,431 S 4/2000 Goins
6,047,830 A 4/2000 Chang
6,062,424 A 5/2000 Simile-Gravina et al.
6,073,795 A 6/2000 Longstreth
6,076,670 A 6/2000 Yeranossian
6,085,916 A 7/2000 Kovacevic et al.
6,098,379 A 8/2000 Spatafora et al.
6,115,921 A 9/2000 Gameau, Sr.
6,134,790 A 10/2000 Watson
6,189,778 B1 2/2001 Kanter
6,202,891 B1 3/2001 Mark
6,226,845 B1 5/2001 Fink
6,250,495 B1 6/2001 Bando
6,250,498 B1 6/2001 Lovejoy
6,289,889 B1 9/2001 Bell et al.
6,298,960 B1 10/2001 Derr
6,336,568 B1 1/2002 Tucker et al.
6,378,729 B1 4/2002 Kodama
D458,070 S 6/2002 Bennett et al.
6,399,079 B1 6/2002 Mehta et al.
6,412,398 B1 7/2002 Norcross et al.
6,412,652 B1 * 7/2002 Woram ..... B65D 21/086 220/521
6,415,465 B1 7/2002 Harrow
6,575,313 B1 6/2003 Chen
6,626,633 B2 9/2003 Jendzurski et al.
6,651,841 B2 11/2003 Tsuchida
6,749,074 B1 6/2004 Hileman et al.
D492,549 S 7/2004 Welch
D493,337 S 7/2004 Welch
6,763,972 B2 7/2004 Graupner
6,786,357 B2 9/2004 Renard
6,786,359 B1 9/2004 Schroeder
6,832,694 B2 12/2004 Goeking et al.

(56) References Cited

U.S. PATENT DOCUMENTS 6,832,698 B1 12/2004 Dybul
6,837,028 B1 1/2005 Miano et al.
6,840,353 B2 1/2005 Arisaka
6,840,420 B1 1/2005 Hudson
6,863,173 B2 3/2005 Bennett
6,880,211 B2 4/2005 Jackson et al.
6,895,672 B2 5/2005 Conforti
6,923,365 B2 8/2005 Auclair et al.
6,945,427 B2 9/2005 Filth
6,951,266 B2 10/2005 Tournier
6,972,033 B2 12/2005 NcNicholas
6,976,348 B1 12/2005 Miano et al.
7,013,568 B2 3/2006 Schmidt
7,066,380 B2 6/2006 Blake
7,076,932 B2 7/2006 Rubin
7,090,455 B2 8/2006 Lamb
7,111,369 B2 9/2006 Ho
D533,034 S 12/2006 Wasserman
7,156,220 B2 1/2007 Olson et al.
D536,222 S 2/2007 Heiberg et al.
7,204,406 B2 4/2007 Bone
7,210,279 B1 5/2007 Ahmed
7,237,700 B2 7/2007 Bulovic
7,249,793 B1 7/2007 Jabr
7,258,233 B2 8/2007 Lee
7,322,172 B2 1/2008 Hoffman et al.
D564,819 S 3/2008 Fosburg et al.
7,412,808 B2 8/2008 Lavi
7,434,692 B2 10/2008 Ginsberg et al.
D591,104 S 4/2009 Oakes
7,513,089 B2 4/2009 Rubin
7,516,831 B2 4/2009 Chang
7,520,247 B2 4/2009 Rutledge
7,669,256 B2 3/2010 Harrow
7,703,665 B2 4/2010 McGowan
7,716,842 B2 5/2010 Sumner-Trivisani et al.
7,731,899 B2 6/2010 Talmer et al.
7,819,234 B2 10/2010 Herzog
7,856,722 B2 12/2010 Lago-Arenas
D631,337 S 1/2011 Prevost
7,905,370 B2 3/2011 Leonetti
8,061,586 B2 11/2011 Fluegel et al.
8,070,013 B2 12/2011 Reinsel et al.
8,083,058 B2 12/2011 Marcinkowski et al.
8,083,097 B2 12/2011 Kaufman
8,152,004 B2 4/2012 Smith et al.
8,210,364 B2 7/2012 Smith et al.
8,272,533 B1 9/2012 D'Amelia et al.
8,296,957 B2 10/2012 Muehlemann
8,297,473 B2 10/2012 Smith
8,302,269 B2 11/2012 Pitman
8,360,273 B2 1/2013 Reinsel et al.
8,444,006 B2 5/2013 Dixon
8,448,816 B2 5/2013 Gordon
8,480,954 B2 7/2013 Talmer et al.
D697,793 S 1/2014 Levy et al.
8,662,345 B1 3/2014 Wang
8,776,379 B2 7/2014 Walters
8,789,704 B2 7/2014 Nowak
8,839,522 B2 9/2014 Walters
8,844,798 B2 9/2014 Linkel
9,095,201 B2 * 8/2015 Simonsen ..... A45F 5/00
9,169,039 B2 10/2015 Freeman
9,198,465 B2 12/2015 Ghini et al.
9,266,646 B2 2/2016 Oakes
9,439,518 B2 9/2016 Oakes
9,560,920 B2 2/2017 Oakes
D783,303 S 4/2017 Roche
D788,485 S 6/2017 Greenwald et al.
2001/0007308 A1 7/2001 Glassman
2001/0025856 A1 10/2001 Lefevre Du Grosriez et al.
2002/0088808 A1 7/2002 Woram et al.
2002/0112445 A1 8/2002 Scaduto
2002/0170918 A1 11/2002 Solovay et al.
2003/0015824 A1 1/2003 Forbes et al.
2003/0098344 A1 5/2003 Blake
2004/0040971 A1 * 3/2004 Athalye ..... B65D 5/3628 220/666
2004/0045398 A1 3/2004 Hayashi
2004/0045860 A1 3/2004 Edgerly et al.
2004/0089670 A1 5/2004 Goeking et al.
2004/0237311 A1 12/2004 Brown et al.
2005/0035136 A1 2/2005 Dathe et al.
2005/0082307 A1 4/2005 Tucker
2005/0116482 A1 6/2005 Harris
2005/0155186 A1 7/2005 McGuyer et al.
2005/0155229 A1 7/2005 Lee
2005/0211722 A1 9/2005 Runnels
2005/0252057 A1 11/2005 Lavi
2006/0000190 A1 1/2006 Behnke et al.
2006/0042986 A1 3/2006 Simkowski
2006/0053638 A1 3/2006 Sumner-Trivisani et al.
2006/0074390 A1 * 4/2006 Price ..... A61F 15/001 604/357
2006/0218795 A1 10/2006 Santa Cruz et al.
2006/0249531 A1 11/2006 Litchfield
2007/0035943 A1 2/2007 Wang
2007/0108141 A1 5/2007 Smith et al.
2007/0131705 A1 6/2007 Behravesh et al.
2007/0193968 A1 8/2007 Smith et al.
2007/0214650 A1 9/2007 Tomazini
2007/0250391 A1 10/2007 Prade et al.
2008/0118609 A1 5/2008 Harlfinger
2008/0121650 A1 5/2008 Smith
2008/0128445 A1 6/2008 Huang et al.
2009/0194557 A1 8/2009 Van Deursen
2010/0084418 A1 4/2010 Reinsel et al.
2010/0147869 A1 6/2010 Iliffe et al.
2010/0170915 A1 7/2010 Reinsel et al.
2010/0264159 A1 10/2010 Gordon
2011/0180562 A1 7/2011 Reinsel et al.
2011/0226797 A1 9/2011 Reinsel et al.
2011/0296693 A1 12/2011 Oakes
2012/0036724 A1 2/2012 Walters
2012/0047744 A1 3/2012 Walters
2012/0080444 A1 4/2012 Smith et al.
2012/0110746 A1 5/2012 Allard Serrano et al.
2012/0145734 A1 6/2012 Walters
2012/0145735 A1 6/2012 Erickson et al.
2012/0145736 A1 6/2012 Walters et al.
2012/0288351 A1 11/2012 Nirmel
2013/0032609 A1 2/2013 Righetti et al.
2013/0043272 A1 2/2013 Oakes
2013/0126548 A1 5/2013 Pourian et al.
2013/0134211 A1 5/2013 Linkel
2013/0140201 A1 * 6/2013 Ghini ..... B65D 5/38 206/267
2013/0152406 A1 6/2013 McFarland
2013/0193157 A1 8/2013 Jongen et al.
2013/0206800 A1 * 8/2013 Simonsen ..... A45F 5/00 224/148.3
2013/0306717 A1 11/2013 Fitzwater et al.
2014/0069930 A1 3/2014 Oakes
2014/0117036 A1 5/2014 Smith
2014/0191024 A1 7/2014 Wnek et al.
2014/0217112 A1 8/2014 Young et al.
2014/0299656 A1 10/2014 Wintermute
2015/0001235 A9 1/2015 Smith
2015/0028045 A1 1/2015 Oakes
2015/0028046 A1 1/2015 Oakes et al.
2015/0041363 A1 2/2015 Freeman
2015/0041484 A1 2/2015 Oakes
2015/0048108 A1 2/2015 Borke
2019/0119022 A1 4/2019 Oakes et al.
2019/0119023 A1 4/2019 Oakes et al.

FOREIGN PATENT DOCUMENTS

CN 101066183 A 11/2007
CN 101495015 A 7/2009
DE 7033238 U 11/1970
DE 7127677 U 11/1971
DE 4139938 A1 6/1993

(56) References Cited

FOREIGN PATENT DOCUMENTS

| | | | | | |
|---|---|---|---|---|---|
| DE | 3151268 | A1 | | 7/1993 | |
| DE | 202005013647 | U1 | | 6/2006 | |
| EP | 0257109 | A1 | | 3/1988 | |
| EP | 0286538 | A1 | | 10/1988 | |
| EP | 0856272 | A3 | | 1/1999 | |
| EP | 1022107 | A1 | | 7/2000 | |
| EP | 1217923 | B1 | | 9/2003 | |
| EP | 1358827 | A2 | | 11/2003 | |
| EP | 1213985 | B1 | | 6/2004 | |
| EP | 1514497 | A1 | | 3/2005 | |
| EP | 1719438 | A1 | | 11/2006 | |
| EP | 1864596 | A2 | | 12/2007 | |
| FR | 2889507 | A1 | | 2/2007 | |
| JP | H06-121727 | A | | 5/1994 | |
| JP | 08011934 | A | * | 1/1996 | ..... B65D 77/245 |
| JP | H08-11934 | A | | 1/1996 | |
| JP | H08-47440 | A | | 2/1996 | |
| JP | 3042582 | U | | 10/1997 | |
| JP | 2001-354214 | A | | 12/2001 | |
| JP | 2004-261336 | A | | 9/2004 | |
| JP | 2007-319493 | A | | 12/2007 | |
| KR | 20-1991-0008085 | | | 10/1991 | |
| KR | 10-2009-0071515 | A | | 7/2009 | |
| KR | 100954569 | B1 | | 4/2010 | |
| TW | M287639 | U | | 2/2006 | |
| TW | M293720 | U | | 7/2006 | |
| WO | 2001005280 | A1 | | 1/2001 | |
| WO | 2001005281 | A1 | | 1/2001 | |
| WO | 2004/028309 | A1 | | 4/2004 | |
| WO | 2007/049982 | A1 | | 5/2007 | |
| WO | 2009/137367 | A2 | | 11/2009 | |

OTHER PUBLICATIONS

European Search Report for EP 08014387.8, dated Nov. 11, 2008, four pages, European Patent Office, Munich, Germany.
Holding Power of Pressure-Sensitive Tape, Aug. 1989, pp. 31-33.
International Search Report and Written Opinion for PCT/US2009/059915, dated Feb. 3, 2010, 13 pages, European Patent Office, Munich, Germany.
International Search Report and Written Opinion for PCT/US2010/000051, dated Aug. 16, 2010, 6 pages.
International Search Report and Written Opinion for PCT/US2011/044931, dated Feb. 28, 2012.
International Search Report and Written Opinion for PCT/US2011/044934, dated Mar. 6, 2012.
International Search Report and Written Opinion for PCT/US2011/058329, dated Feb. 29, 2012.
International Search Report and Written Opinion for PCT/US2011/058767, dated Feb. 29, 2012.
International Search Report and Written Opinion for PCT/US2011/064057, dated Feb. 29, 2012.
International Searching Authority, "International Search Report and Written Opinion for PCT/US2014/047463", dated Nov. 26, 2014, 22 pages, Korean Intellectual Property Office, South Korea.
International Searching Authority, "International Search Report and Written Opinion for PCT/US2014/050166", dated Nov. 20, 2014, 11 pages, Korean Intellectual Property Office, South Korea.
International Searching Authority, "International Search Report and Written Opinion for PCT/US2014/050169", dated Jan. 9, 2015, 11 pages, Korean Intellectual Property Office, South Korea.
International Searching Authority, "International Search Report and Written Opinion for PCT/US2014/051632", dated Dec. 3, 2014, 9 pages, Korean Intellectual Property Office, South Korea.
International Searching Authority, "International Search Report and Written Opinion for PCT/US2014/051639", dated Dec. 9, 2014, 9 pages, Korean Intellectual Property Office, South Korea.
PCT International Search Report and Written Opinion PCT/US2007/083752, dated Mar. 11, 2008, 10 pages.
PCT International Search Report and Written Opinion PCT/US2007/083922, dated Nov. 17, 2008, 10 pages.
Peel Adhesion for Single Coated Pressure-Sensitive Tapes 180 Angle, Aug. 1989, pp. 21-22.
Supplementary European Search Report for EP 11793088, dated Sep. 25, 2013.
Supplementary European Search Report for European App. No. EP 14 83 0098.1, mailed by the European Patent Office dated Jan. 19, 2017.
Tack Rolling Ball, Aug. 1989, pp. 29-30.
International Searching Authority, "International Search Report and Written Opinion for PCT/US2017/037233", dated Sep. 5, 2017.
European Patent Office, "Extended European Search Report for Application No. 11820327.2", dated Oct. 2, 2015, 7 pages.
European Patent Office, "Extended European Search Report for Application No. 11816779.0", dated Oct. 2, 2015, 8 pages.
International Search Report and Written Opinion for International Application No. PCT/US2013/022455, mailed by the International Searching Authority dated May 30, 2013.

* cited by examiner

CUTLERY DISPENSER AND RELATED METHODS

CROSS-REFERENCE TO RELATED APPLICATIONS

This application is a division of U.S. application Ser. No. 14/336,701, filed on Jul. 21, 2014, which claims the benefit of U.S. Provisional Application No. 61/858,194, filed on Jul. 25, 2013, each of which is incorporated herein by reference in its entirety.

FIELD OF THE DISCLOSURE

The present disclosure relates generally to disposable cutlery and more particularly to a cutlery dispenser and related methods for dispensing wrapped disposable cutlery.

BACKGROUND OF THE DISCLOSURE

Disposable cutlery may be provided as a less expensive alternative to reusable cutlery, for example, at eating facilities or social gatherings where it is undesirable or cost prohibitive to clean the cutlery for reuse. However, providing disposable cutlery may present a number of potential drawbacks related to the manner in which the cutlery is provided.

Certain eating facilities may provide disposable cutlery in loose form within open-air bins or similar containers in which all patrons place their hands to grasp and retrieve a fork, spoon, knife, or spork. Open-air bins are relatively unhygienic, however, and may facilitate transmission of bacteria and the like from one patron to the cutlery and ultimately to another patron. This concern may be partially addressed by individually wrapping the cutlery utensils in disposable packaging, although bacteria still may be transmitted via patron contact with the packaging when selecting cutlery from the bins. The use of open-air bins also may result in some patrons taking more cutlery than necessary, either intentionally or unintentionally, which increases the overall cost of providing the cutlery. For these and other reasons, it may be desirable to provide disposable cutlery in a manner other than from open-air bins.

The above-noted drawbacks may be addressed by dispensing disposable cutlery from enclosed dispensers configured to contain a large supply of cutlery utensils and to dispense the utensils one at a time to each patron. The cutlery may be provided in loose or bundled form in a shipping container, removed from the container, and then loaded into a compartment of the dispenser for later dispensing therefrom. In this manner, the loading of the dispenser may be a time consuming and tedious task, particularly for a high-volume location, potentially undermining the desirability of dispensing the disposable cutlery from a dispenser. Once loaded into the dispenser, the cutlery utensils may be dispensed one at a time to patrons by operation of a lever arm assembly, a rotating belt assembly, a gear assembly, or another dispensing mechanism. The mechanics of these dispensing mechanisms may be relatively complex, and thus the dispenser may be subject to various forms of malfunction, such as jamming during an attempted dispense. Moreover, certain dispensing mechanisms may have a tendency to unintentionally dispense more than one utensil at a time, defeating one of the potential advantages of using a cutlery dispenser—reducing the cost associated with patrons taking more cutlery than necessary. Further, due to their often complex and cumbersome designs, cutlery dispensers may occupy a large amount of space in an already crowded eating facility, which space could otherwise be used for alternative purposes.

There is thus a desire for an improved cutlery dispenser and related method for dispensing disposable cutlery to address one or more of the potential drawbacks discussed above.

SUMMARY OF THE DISCLOSURE

In one aspect, the present disclosure provides a cutlery dispenser for dispensing wrapped cutlery. The cutlery dispenser may include a case configured to expand from a compact configuration into an expanded configuration. The cutlery dispenser also may include a wrapped cutlery band disposed within the case and configured to be dispensed therefrom.

In another aspect, the present disclosure provides a method for dispensing wrapped cutlery. The method may include the step of providing a cutlery dispenser including a case and a wrapped cutlery band disposed within the case. The method also may include the step of expanding the case from a compact configuration into an expanded configuration. The method further may include the step of dispensing at least a portion of the wrapped cutlery band from the case.

In still another aspect, the present disclosure provides a cutlery dispenser for dispensing wrapped cutlery. The cutlery dispenser may include a case configured to contain and allow a wrapped cutlery band to be dispensed therefrom, the wrapped cutlery band including a plurality of cutlery packets separably connected to one another. The case may be configured to expand from a compact configuration into an expanded configuration.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating example embodiments of the disclosure, in which the use of the same reference numerals indicates similar or identical items. Certain embodiments may include elements and/or components other than those illustrated in the drawings, and some elements and/or components may not be present in certain embodiments.

DETAILED DESCRIPTION

Figure 1A:
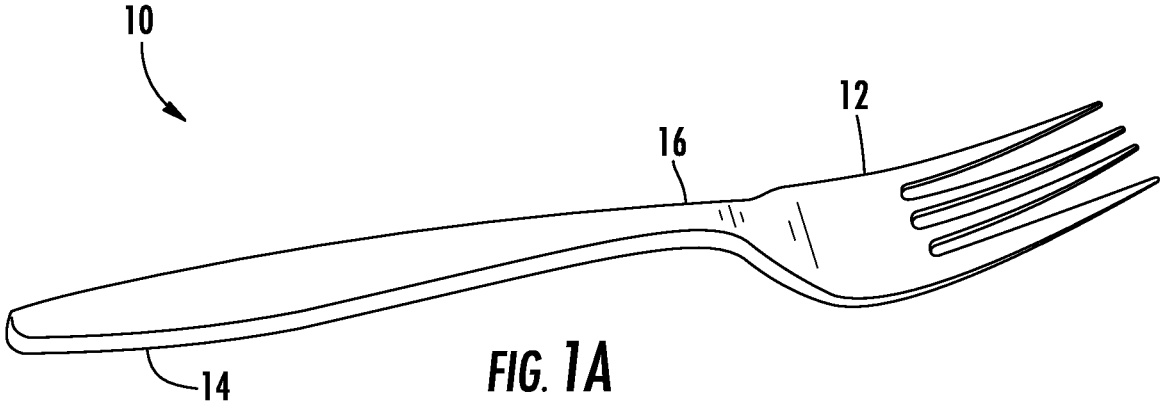
FIG. 1A is a perspective view of an example disposable cutlery utensil in accordance with one or more embodiments of the disclosure.

The present disclosure includes example embodiments of cutlery dispensers and related methods for dispensing disposable cutlery to address one or more of the drawbacks discussed above. Reference is made herein to the accompanying drawings illustrating the example embodiments of the disclosure, in which the use of the same reference numerals indicates similar or identical items. Throughout the disclosure, depending on the context, singular and plural terminology may be used interchangeably.

Figure 1B:
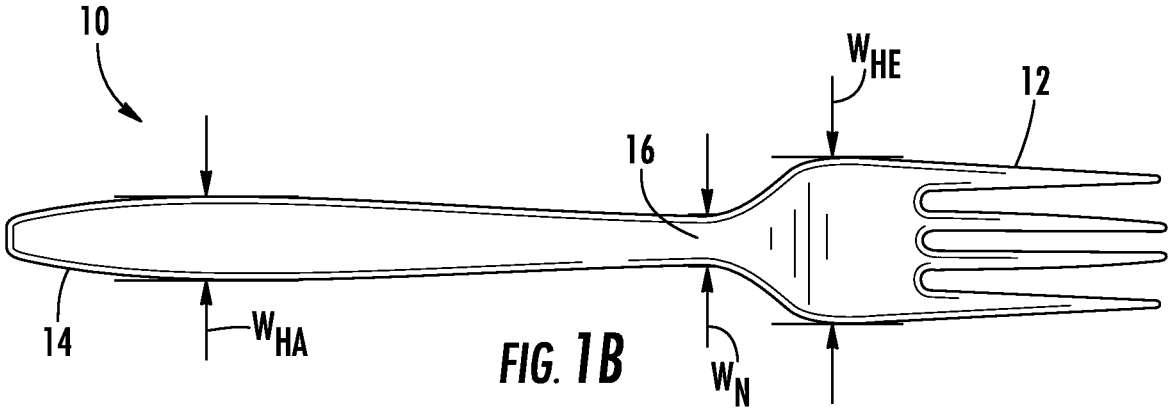
FIG. 1B is a top view of the example disposable cutlery utensil of FIG. 1A.

FIGS. 1A and 1B show a perspective view and a top view, respectively, of an example disposable cutlery utensil 10 according to one or more embodiments as may be described herein. Although the utensil 10 is shown as a fork in FIGS. 1A and 1B, the utensil 10 may be any type of cutlery utensil, including, for example, a fork, a spoon, a knife, or a spork. In some embodiments, the utensil 10 may be constructed of a moldable material. The moldable material may include a plastic, a combination of plastics, or a combination of plastics and other materials suitable for use in forming disposable cutlery. For example, the moldable material may include one or more of polystyrene, polyethylene, and polypropylene. In some embodiments, the utensil 10 may be constructed of a recyclable material.

As is shown, the utensil 10 may include a functional head 12, a handle 14, and a neck 16. The head 12 may be positioned at one end of the utensil 10 and may be configured to perform a function to assist a user in the consumption of food. For example, the head 12 may be configured for cutting, piercing, and/or scooping certain types of food for consumption. The handle 14 may be positioned at an opposite end of the utensil 10 and may be configured to be grasped by the user for holding and/or manipulating the utensil 10. FIG. 1B illustrates the relative widths of the head 12, the handle 14, and the neck 16 of the utensil 10 according to some embodiments. As is shown, a maximum width $W_{HE}$ of the head 12 may be greater than a maximum width $W_{HA}$ of the handle 14, and the maximum width $W_{HA}$ of the handle 14 may be greater than a maximum width $W_N$ of the neck 16. In this manner, the head 12 may be the widest portion of the utensil 10. According to other embodiments, the handle 14 or the neck 16 may be the widest portion of the utensil 10. For example, the handle 14 or the neck 16 may include a flange or shoulder feature having a maximum width that is greater than the maximum width $W_{HE}$ of the head 12. In some embodiments, the utensil 10 may include a flange or shoulder feature in addition to the head 12, the handle 14, and the neck 16, and the flange or shoulder feature may be the widest portion of the utensil 10. Such embodiments may be particularly useful when the utensil 10 is a knife, as the flange or shoulder feature may facilitate dispensing of the utensil 10 as desired via certain cutlery dispensers described herein below. In some embodiments, the utensil 10 may not include a neck 16. In such embodiments, the head 12 may extend directly from the handle 14.

Figure 2A:
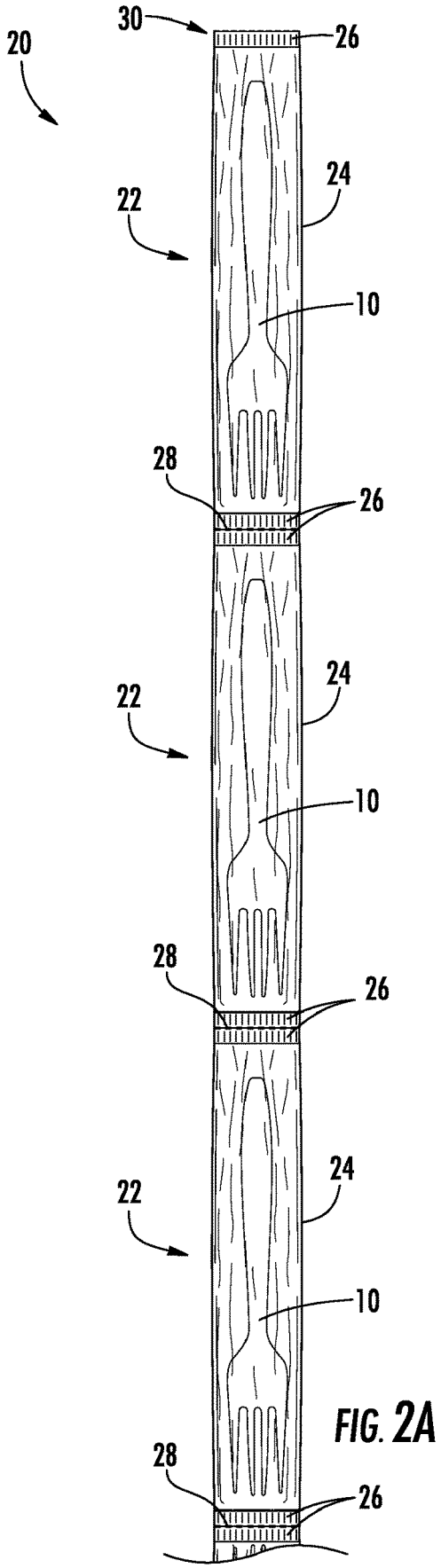
FIG. 2A is a top view of an example continuous band of wrapped disposable cutlery in accordance with one or more embodiments of the disclosure.

FIG. 2A shows an example continuous band of wrapped disposable cutlery 20 (which also may be referred to herein as a "wrapped cutlery band" or simply a "band") according to one or more embodiments as may be described herein. The band 20 may include a plurality of sealed cutlery packets 22 separably connected to one another in a serial manner. Each cutlery packet 22 may include an elongated pouch 24 and at least one disposable cutlery utensil 10 disposed within the pouch 24. In some embodiments, as is shown in FIG. 2A, each cutlery packet 22 may include a single utensil 10 disposed within the pouch 24. In other embodiments, more than one utensil 10 may be disposed within the pouch 24 of each cutlery packet 22. The cutlery packets 22 may have an elongated shape to accommodate the utensils 10 and may be connected end to end to form the wrapped cutlery band 20, as is shown.

The pouches 24 may be formed of a thin layer of disposable packaging material sealed in a manner to contain the utensils 10 therein. Specifically, each pouch 24 may include a seal 26 extending along both a leading end and a trailing end of the cutlery packet 22. In some embodiments, each pouch 24 also may include a seal 26 extending along one or more sides of the cutlery packet 22. The pouches 24 may be constructed of a plastic, such as, for example, polyethylene, and the seals 26 may be formed by heat sealing the plastic along the ends and/or sides of the cutlery packets 22. Other suitable materials of construction may be used to form the pouches 24, and other suitable methods of forming the seals 26 may be used.

In some embodiments, the cutlery packets 22 may be separably connected to one another in a serial manner by zones of weakness 28 extending between the pouches 24 of adjacent cutlery packets 22. The zones of weakness 28 may be perforated zones, as is shown in FIG. 2A, including a plurality of perforations formed mechanically or otherwise, such as by a laser, according to various methods. Alternatively, the zones of weakness 28 may be scored zones including one or more score lines formed mechanically or otherwise, such as by a laser, according to various methods. Other suitable methods of forming the zones of weakness 28 may be used. As is shown in FIG. 2A, the zones of weakness 28 may be positioned between adjacent seals 26 of adjacent pouches 24 to facilitate separation of the cutlery packets 22 from one another via application of a tensile force. In this manner, upon separation of adjacent cutlery packets 22, the utensils 10 may remain sealed within their respective pouches 24. In other embodiments, the cutlery packets 22 may be separably connected to one another by a releasable adhesive applied to and joining the adjacent ends of adjacent pouches 24 to facilitate separation of the cutlery packets 22 in a similar manner via application of a tensile force. Still other suitable methods of separably connecting the cutlery packets 22 may be used.

In some embodiments, all of the utensils 10 of the wrapped cutlery band 20 may be oriented in a similar manner within their respective pouches 24. For example, the handles 14 of the utensils 10 may be oriented toward a leading end 30 of the band 20, as is shown in FIG. 2A. In this manner, the cutlery packet 22 at the leading end 30 easily may be grasped over the handle 14 of the utensil 10 contained therein and pulled to separate the cutlery packet 22 from the remainder of the band 20. Alternatively, the heads 12 of the utensils 10 may be oriented toward the leading end 30 of the band 20. In other embodiments, the utensils 10 of the band 20 may not be oriented in a similar manner within their respective pouches 24. For example, the handles 14 of the utensils 10 within some cutlery packets 22 may be oriented toward the leading end 30 of the band 20, while the heads 12 of the utensils 10 within other cutlery packets 22 may be oriented toward the leading end 30 of the band 20. As another example, each cutlery packet 22 may include one utensil 10 with the handle 14 oriented toward the leading end 30 of the band 20, and another utensil 10 with the head 12 oriented toward the leading end 30 of the band 20. In some embodiments, the wrapped cutlery band 20 may include a starter strip 32 positioned at the leading end 30 of the band 20 and configured to facilitate pulling the band 20 for loading a cutlery dispenser, as may be described in detail herein below.

Figure 2B:
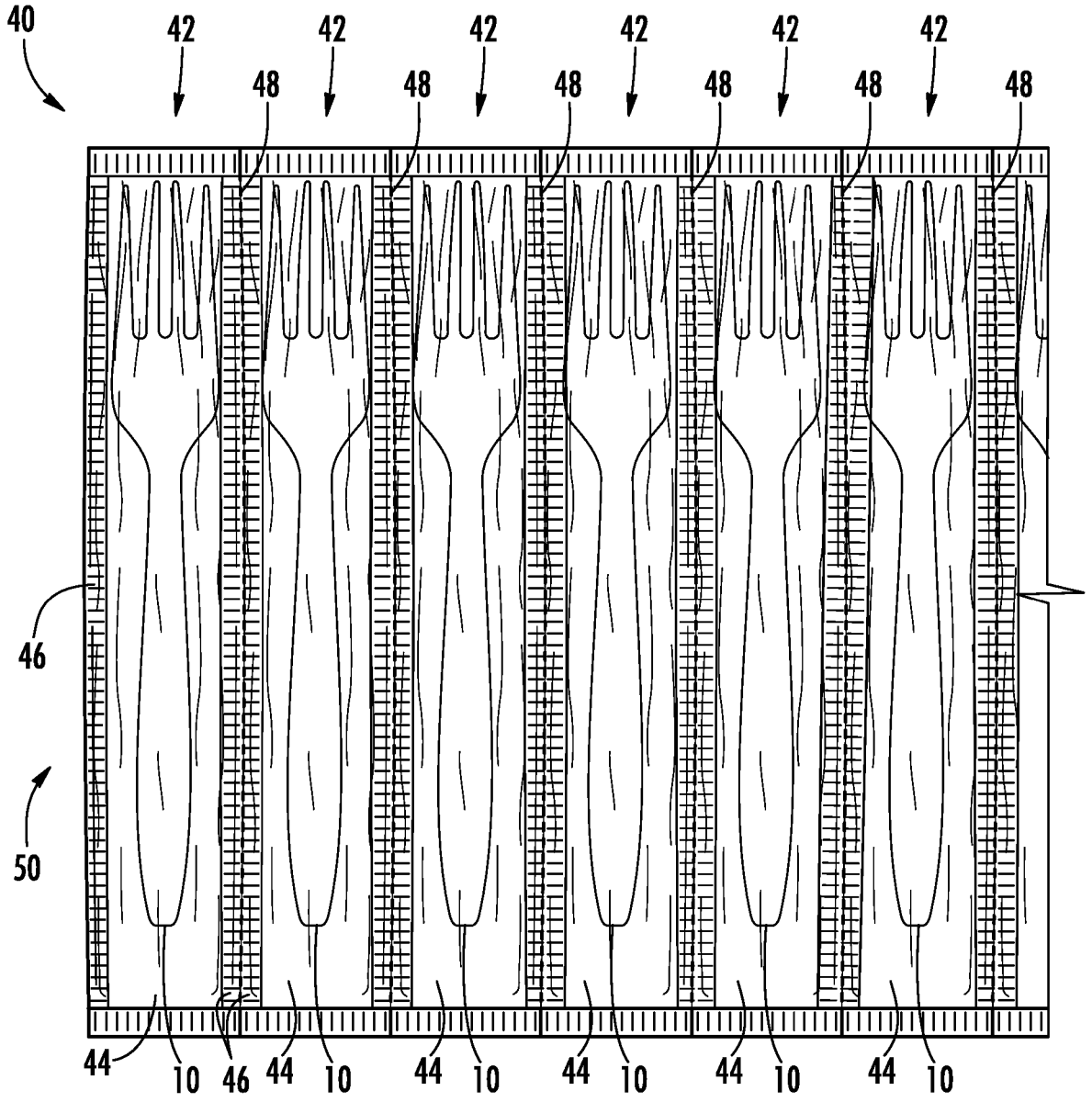
FIG. 2B is a top view of an example continuous band of wrapped disposable cutlery in accordance with one or more embodiments of the disclosure.

FIG. 2B shows an example continuous band of wrapped disposable cutlery 40 according to one or more embodiments as may be described herein. The band 40 may be generally similar to the band 20 described above with respect to FIG. 2A, although certain differences may be described herein below. The band 40 may include a plurality of sealed cutlery packets 42 separably connected to one another in a serial manner. Each cutlery packet 42 may include an elongated pouch 44 and at least one disposable cutlery utensil 10 disposed within the pouch 44. In some embodiments, as is shown in FIG. 2B, each cutlery packet 42 may include a single utensil 10 disposed within the pouch 44. In other embodiments, more than one utensil 10 may be disposed within the pouch 44 of each cutlery packet 42. The cutlery packets 42 may have an elongated shape to accommodate the utensils 10 and may be connected side to side to form the wrapped cutlery band 40, as is shown.

The pouches 44 may be formed of a thin layer of disposable packaging material sealed in a manner to contain the utensils 10 therein. Specifically, each pouch 44 may include a seal 46 extending along both a leading side and a trailing side of the cutlery packet 42. In some embodiments, each pouch 44 also may include a seal 46 extending along the ends of the cutlery packet 42. The pouches 44 may be constructed of a plastic, such as, for example, polyethylene, and the seals 46 may be formed by heat sealing the plastic along the ends and/or sides of the cutlery packets 42. Other suitable materials of construction may be used to form the pouches 44, and other suitable methods of forming the seals 46 may be used.

In some embodiments, the cutlery packets 42 may be separably connected to one another in a serial manner by zones of weakness 48 extending between the pouches 44 of adjacent cutlery packets 42. The zones of weakness 48 may be perforated zones, as is shown in FIG. 2B, including a plurality of perforations formed mechanically or otherwise, such as by a laser, according to various methods. Alternatively, the zones of weakness 48 may be scored zones including one or more score lines formed mechanically or otherwise, such as by a laser, according to various methods. Other suitable methods of forming the zones of weakness 48 may be used. As is shown in FIG. 2B, the zones of weakness 48 may be positioned between adjacent seals 46 of adjacent pouches 44 to facilitate separation of the cutlery packets 42 from one another via application of a tensile force. In this manner, upon separation of adjacent cutlery packets 42, the utensils 10 may remain sealed within their respective pouches 44. In other embodiments, the cutlery packets 42 may be separably connected to one another by a releasable adhesive applied to and joining the adjacent ends of adjacent pouches 44 to facilitate separation of the cutlery packets 42 in a similar manner via application of a tensile force. Still other suitable methods of separably connecting the cutlery packets 42 may be used.

In some embodiments, all of the utensils 10 of the wrapped cutlery band 40 may be oriented in a similar manner within their respective pouches 44. For example, the handles 14 of the utensils 10 may be oriented toward one side of the band 40, as is shown in FIG. 2B. In other embodiments, the utensils 10 of the band 40 may not be oriented in a similar manner within their respective pouches 44. For example, the handles 14 of the utensils 10 within some cutlery packets 42 may be oriented toward one side of the band 40, while the heads 12 of the utensils 10 within other cutlery packets 42 may be oriented toward another side of the band 40. As another example, each cutlery packet 42 may include one utensil 10 with the handle 14 oriented toward one side of the band 40, and another utensil 10 with the head 12 oriented toward another side of the band 20. In some embodiments, the wrapped cutlery band 40 may include a starter strip 52 positioned at a leading end 50 of the band 40 and configured to facilitate pulling the band 24 for loading a cutlery dispenser, as may be described in detail herein below.

FIGS. 3A-3E show various views of an example cutlery dispenser 100 for dispensing wrapped disposable cutlery according to one or more embodiments as may be described herein. The cutlery dispenser 100 may include an expandable case 110 and a wrapped cutlery band 20 disposed within the case 110 and configured to be dispensed therefrom. Although the cutlery dispenser 100 may be shown and described herein as including the wrapped cutlery band 20 for dispensing therefrom, the cutlery dispenser 100 alternatively may include the wrapped cutlery band 40 for dispensing therefrom.

Figure 3A:
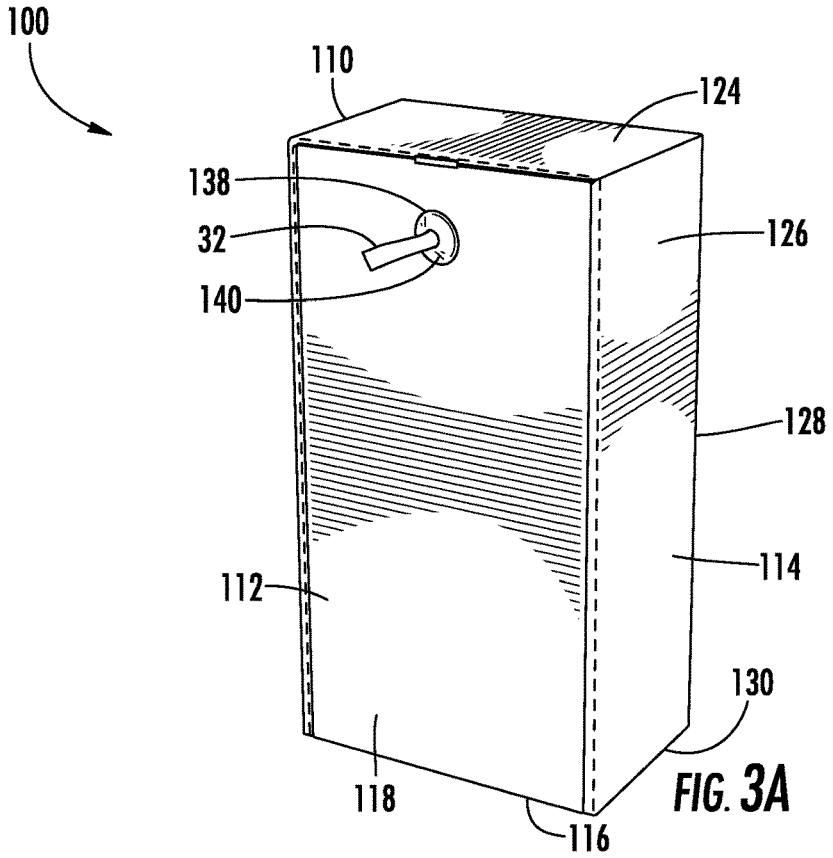
FIG. 3A is a perspective view of an example cutlery dispenser for dispensing a continuous band of wrapped disposable cutlery in accordance with one or more embodiments of the disclosure, showing a case of the dispenser in a compact configuration.
Figure 3B:
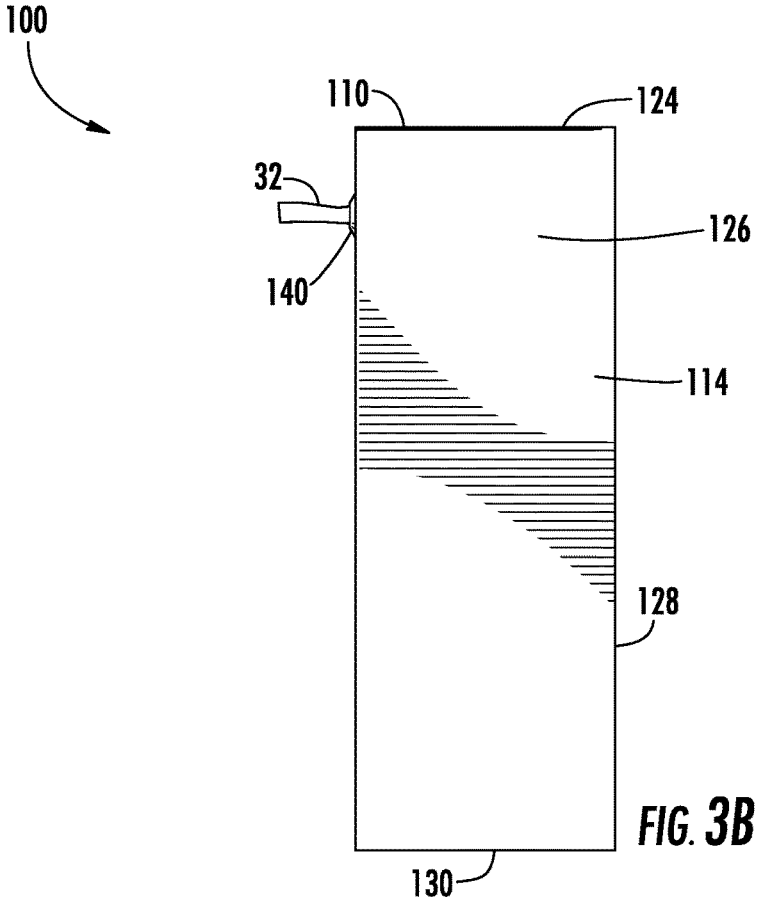
FIG. 3B is a side view of the example cutlery dispenser of FIG. 3A, showing the case in the compact configuration.
Figure 3C:
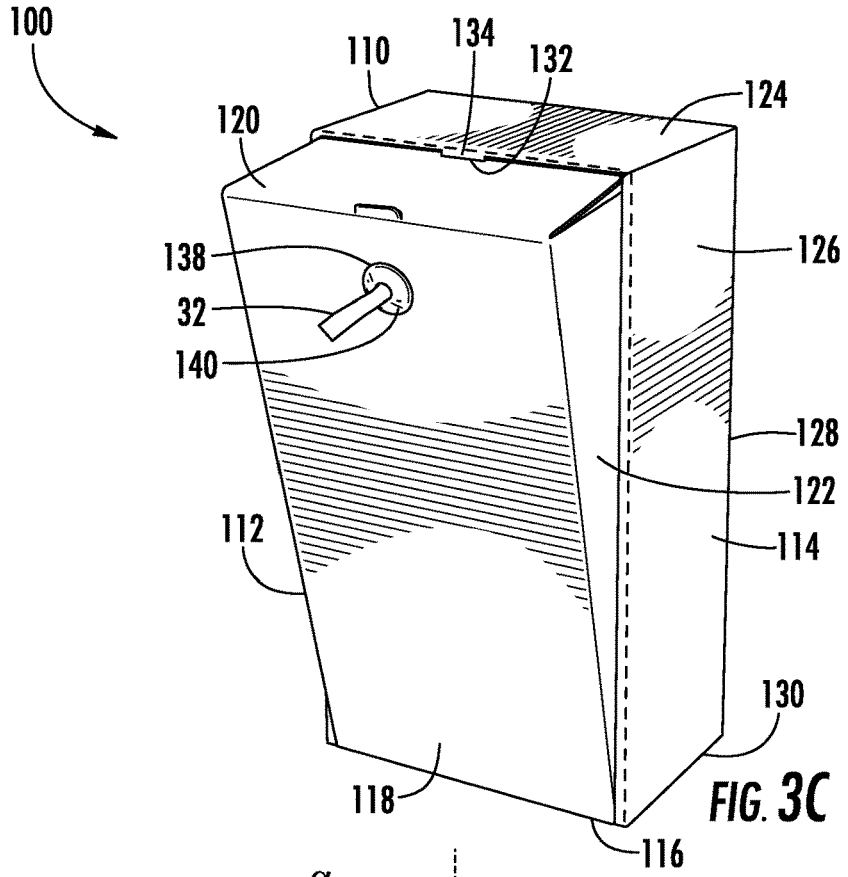
FIG. 3C is a perspective view of the example cutlery dispenser of FIG. 3A, showing the case in an expanded configuration.
Figure 3D:
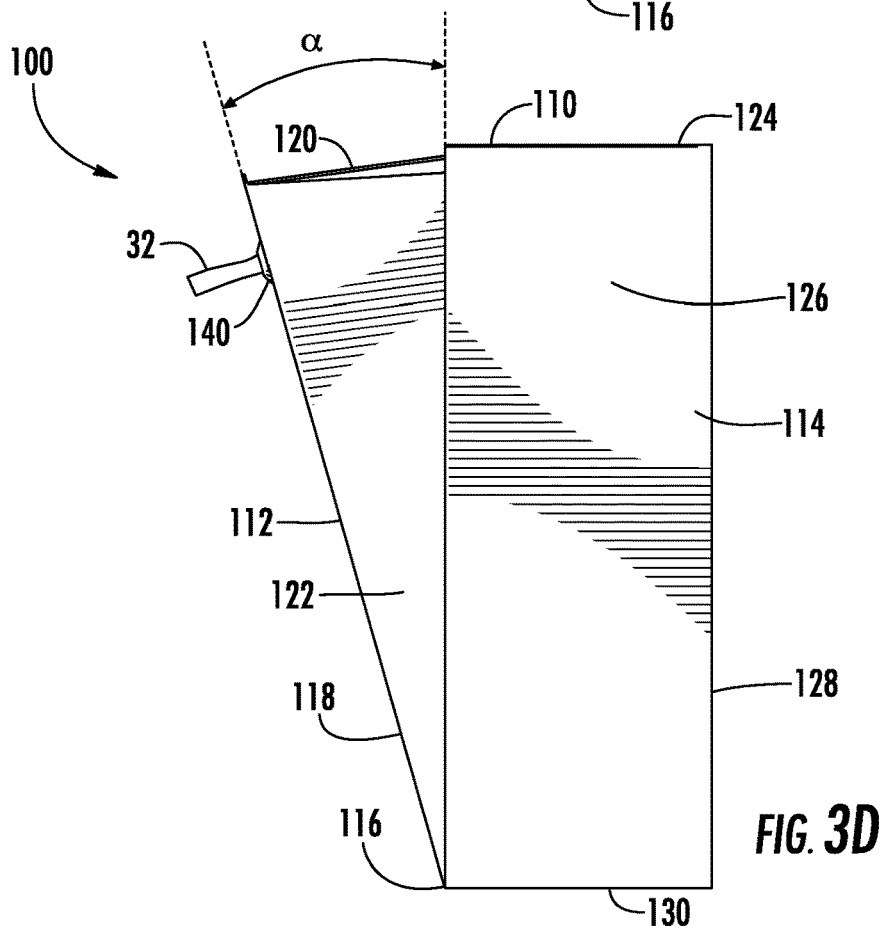
FIG. 3D is a side view of the example cutlery dispenser of FIG. 3A, showing the case in the expanded configuration.

The expandable case 110 may be configured to expand from a compact configuration, as is shown in FIGS. 3A and 3B, into an expanded configuration, as is shown in FIGS. 3C and 3D. In this manner, the compact configuration of the case 110 may define a first internal volume, and the expanded configuration of the case 110 may define a second internal volume greater than the first internal volume. In some embodiments, the case 110 may include a lid 112 and a base 114, and the lid 112 may be movable relative to the base 114 to expand the case 110 from the compact configuration into the expanded configuration. Specifically, as is shown, the lid 112 may be configured to pivot relative to the base 114 to expand the case 110 from the compact configuration into the expanded configuration.

In some embodiments, the lid 112 may extend along a front of the case 110 and may pivot forward relative to the base 114 about a hinge connection 116 between the lid 112 and the base 114. The hinge connection 116 may be positioned at the top of the case 110 or at the bottom of the case 110, as is shown. According to the embodiment of FIGS. 3A-3E, the lid 112 may include a front wall 118, a top wall 120, and two side walls 122. Further, the base 114 may include a top wall 124, two side walls 126, a back wall 128, and a bottom wall 130. Other structural configurations of the case 110 may be used. When the case 110 is in the compact configuration, the lid 112 may be disposed about or within the base 114, as is shown in FIGS. 3A and 3B, defining the first internal volume therebetween. Upon expanding the case 110 into the expanded configuration, the lid 112 may remain partially disposed about or within the base 114, as is shown in FIGS. 3C and 3D, defining the second internal volume therebetween. In some embodiments, the lid 112 may include a slot 132 defined in the top wall 120, and the base 114 may include a mating tab 134 extending from the top wall 124. The tab 134 may engage the slot 132 when the case 110 is in the expanded configuration to prevent the lid 112 from pivoting forward further relative to the base 114. The lid 112 may pivot forward an angle $\alpha$ relative to the front of the base 114. The angle $\alpha$ may be within a suitable range to provide a suitable angle of approach for patrons using the cutlery dispenser 100 and to provide a suitable headspace, as described herein below. In some embodiments, the angle $\alpha$ may be within a range of about 10° to about 60°. In some embodiments, the angle $\alpha$ may be about 30°, as is shown. Other suitable angles of pivoting the lid 112 may be used.

Figure 3E:
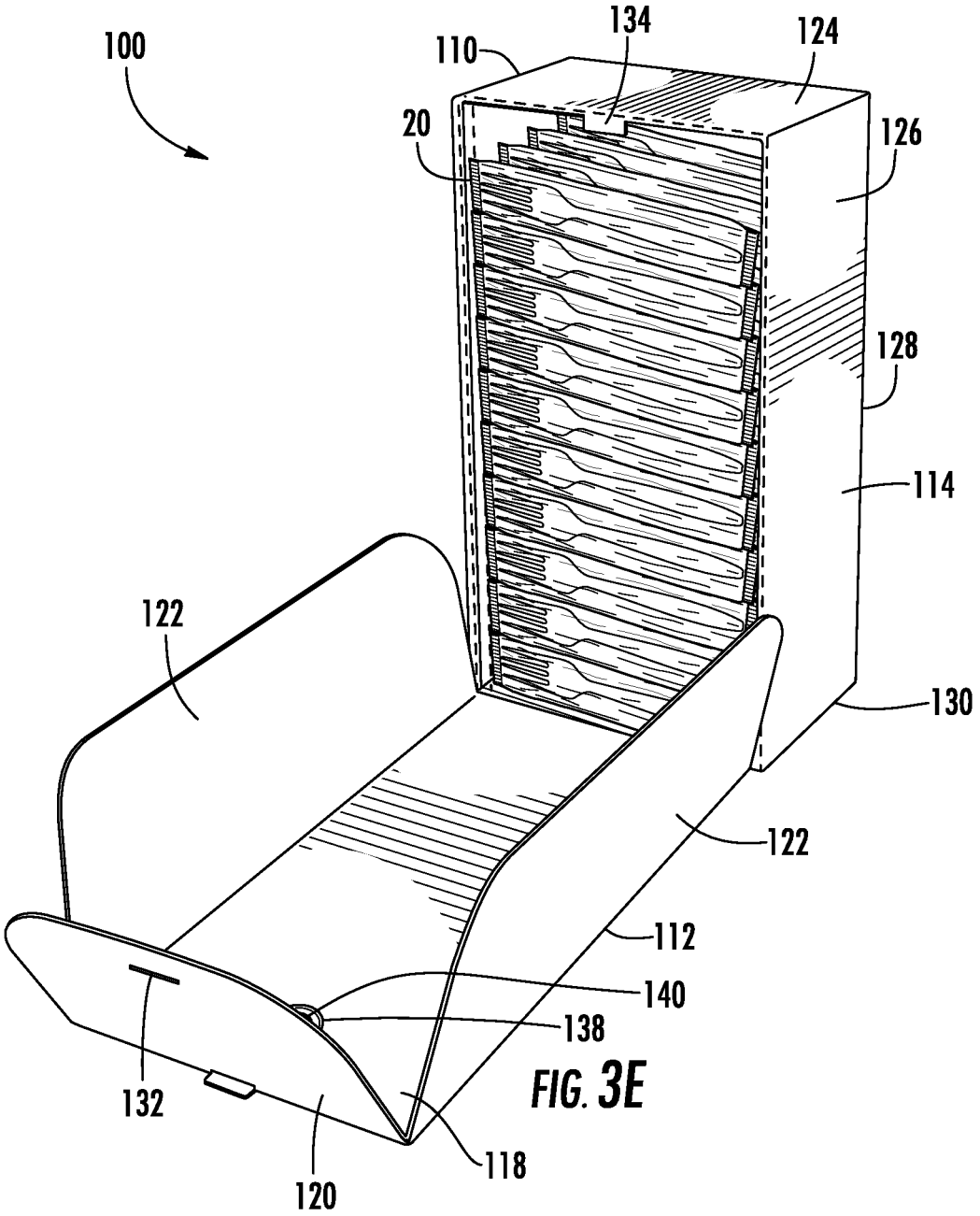
FIG. 3E is a perspective view of the example cutlery dispenser of FIG. 3A, showing the case in an open configuration.

FIG. 3E shows the cutlery dispenser 100 including the case 110 in an open configuration solely for the purpose of illustrating the wrapped cutlery band 20 disposed therein prior to being dispensed therefrom. The wrapped cutlery band 20 may be disposed within the case 110 in a serpentine or zig-zag manner such that adjacent cutlery packets 22 are folded over one another and adjacent groups of cutlery packets 22 are stacked on top of or next to one another. Alternatively, the wrapped cutlery band 20 may be disposed within the case 110 in a rolled manner such that adjacent cutlery packets 22 are rolled over one another. Other suitable configurations of disposing the band 20 within the case may be used. In some embodiments, the wrapped cutlery band 20 may substantially fill the first internal volume defined by the compact configuration of the case 110 prior to dispensing of the band 20. Upon expansion of the case 110, the expanded configuration may define a headspace between the wrapped cutlery band 20 and the top wall 124 of the base 114. Specifically, after pivoting the lid 112, the wrapped cutlery band 20 may settle forward and fill a lower portion of the second internal volume defined by the case 110, resulting in the headspace between the band 20 and the top wall 124. Alternatively, the wrapped cutlery band 20 may remain in place after pivoting the lid 112, the headspace extending between the band 20 and the front wall 118 of the lid 112. The headspace may be configured to allow the wrapped cutlery band 20, specifically the individual cutlery packets 22, to orient within the case 110 to facilitate dispensing therefrom. In some embodiments, a height of the headspace may be greater than half of a length of the cutlery utensil 10. In some embodiments, the height of the headspace may be about the length of the cutlery utensil 10. Other suitable sizes for the height of the headspace may be used.

The case 110 may include an opening 138 defined in a wall of the case 110 and configured to allow the wrapped cutlery band 20 to be dispensed therethrough. Specifically, the opening 138 may be defined in the front wall 118 of the lid 112, as is shown. In some embodiments, the opening 138 may be configured to allow the cutlery packets 22 of the band 20 to be dispensed one at a time therethrough. The cutlery dispenser 100 also may include a nozzle 140 positioned about or within the opening 138 and configured to allow the wrapped cutlery band 20 to be dispensed therethrough. In some embodiments, the nozzle 140 may be configured to allow the cutlery packets 22 of the band 20 to be dispensed one at a time therethrough, as may be described in detail herein below with respect to FIGS. 5A-5D. As noted above, the wrapped cutlery band 20 may include a starter strip 32 positioned at the leading end 30 of the band 20. In some embodiments, as is shown, the starter strip 32 may extend through the opening 138 and the nozzle 140. In this manner, the starter strip 32 may be configured to facilitate pulling the wrapped cutlery band 20 through the opening 138 and the nozzle 140 for subsequent dispensing of the cutlery packets 22 from the cutlery dispenser 100.

In some embodiments, the case 110 may be constructed of cardboard and may be disposable. In this manner, the case 110 may be disposed of after the wrapped cutlery band 20 has been dispensed therefrom. In other embodiments, the case 110 may be constructed of a plastic and may be reusable. In this manner, after the wrapped cutlery band 20 has been dispensed from the case 110, another wrapped cutlery band 20 may be loaded into the case 110 for reuse. Other suitable materials of construction may be used for the case 110, which may be either disposable or reusable. In some embodiments, both the case 110 and the nozzle 140 may be disposable, such that the overall cutlery dispenser 100 is disposable. In this manner, the case 110 and the nozzle 140 may be disposed of after the wrapped cutlery band 20 has been dispensed.

Although the cutlery dispenser 100 may be oriented and operated in the orientation shown and described herein above with respect to FIGS. 3A-3E, the dispenser 100 also may be oriented and operated in other orientations. For example, the cutlery dispenser 100 may be oriented such that the lid 112 extends along a top of the case 110 and may pivot upward relative to the base 114 into the expanded configuration. In this manner, the expanded configuration may define the headspace between the wrapped cutlery band 20 and the wall 118 of the lid 112. Based on the various possible orientations of the case 110, the adjectives "front", "back", "top", "bottom", and "side" used to describe the different walls of the case 110 may be changed to appropriately describe the respective orientations.

FIGS. 4A-4E show various views of an example cutlery dispenser 200 for dispensing wrapped disposable cutlery according to one or more embodiments as may be described herein. The cutlery dispenser 200 may be generally similar to the dispenser 100 described above with respect to FIGS. 3A-3E, although certain differences may be described herein below. The cutlery dispenser 200 may include an expandable case 210 and a wrapped cutlery band 20 disposed within the case 210 and configured to be dispensed therefrom. Although the cutlery dispenser 200 may be shown and described herein as including the wrapped cutlery band 20 for dispensing therefrom, the cutlery dispenser 200 alternatively may include the wrapped cutlery band 40 for dispensing therefrom.

Figure 4A:
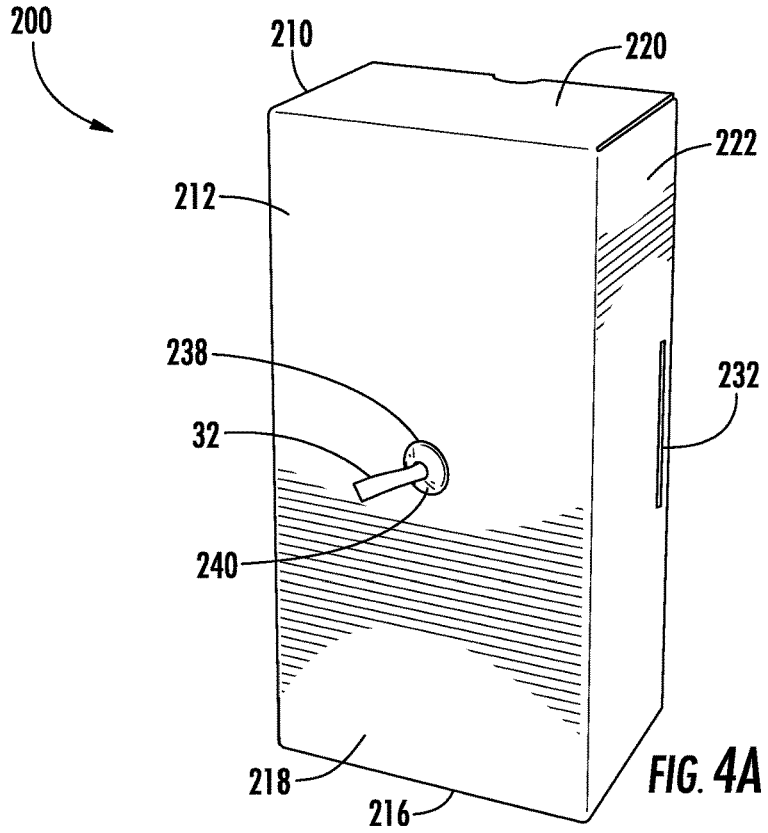
FIG. 4A is a perspective view of an example cutlery dispenser for dispensing a continuous band of wrapped disposable cutlery in accordance with one or more embodiments of the disclosure, showing a case of the dispenser in a compact configuration.
Figure 4B:
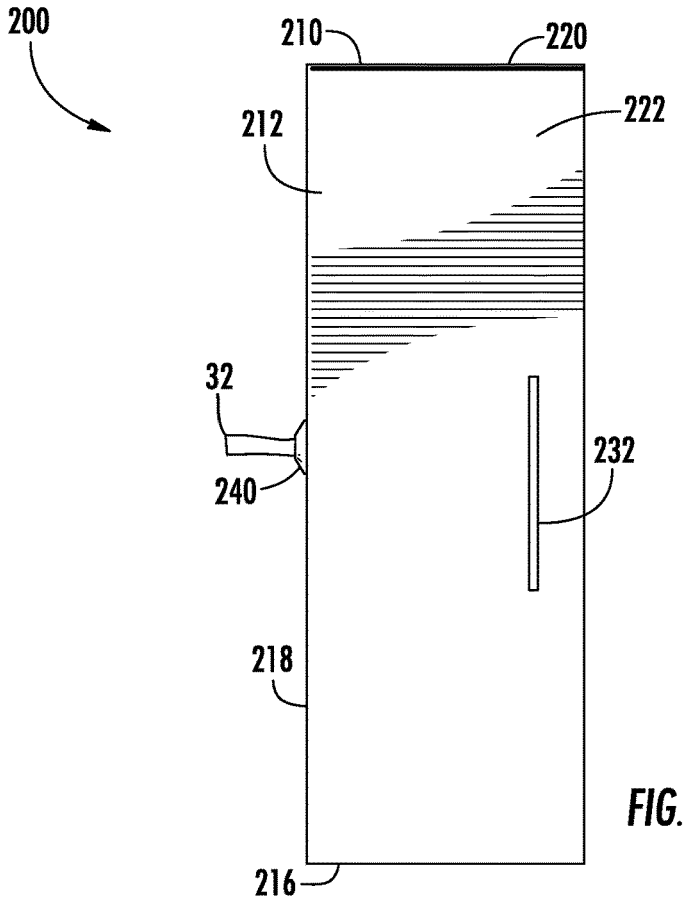
FIG. 4B is a side view of the example cutlery dispenser of FIG. 4A, showing the case in the compact configuration.
Figure 4C:
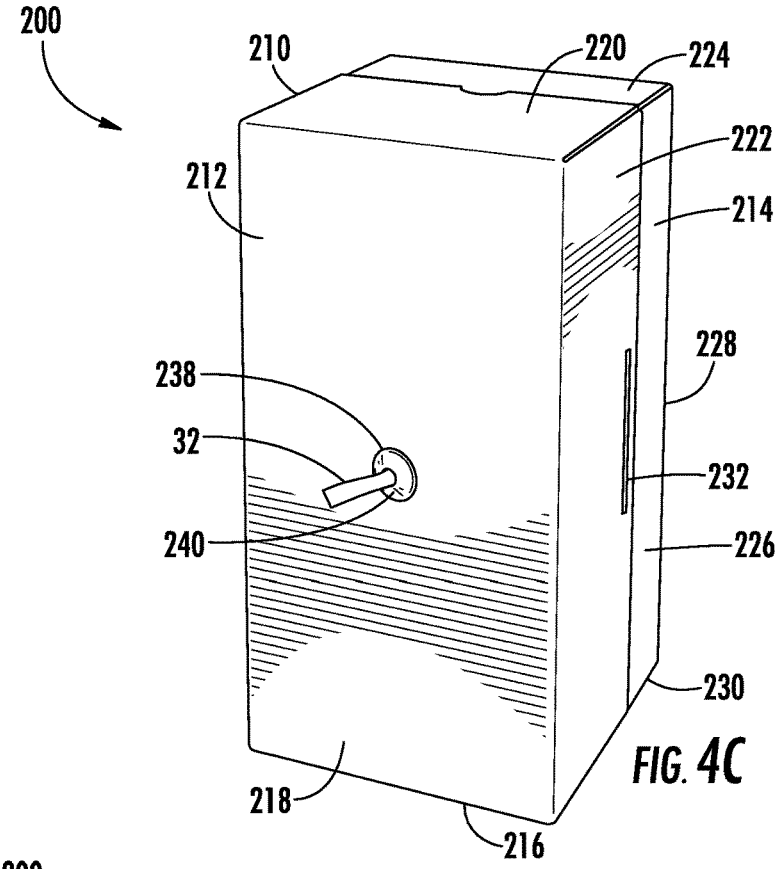
FIG. 4C is a perspective view of the example cutlery dispenser of FIG. 4A, showing the case in an expanded configuration.
Figure 4D:
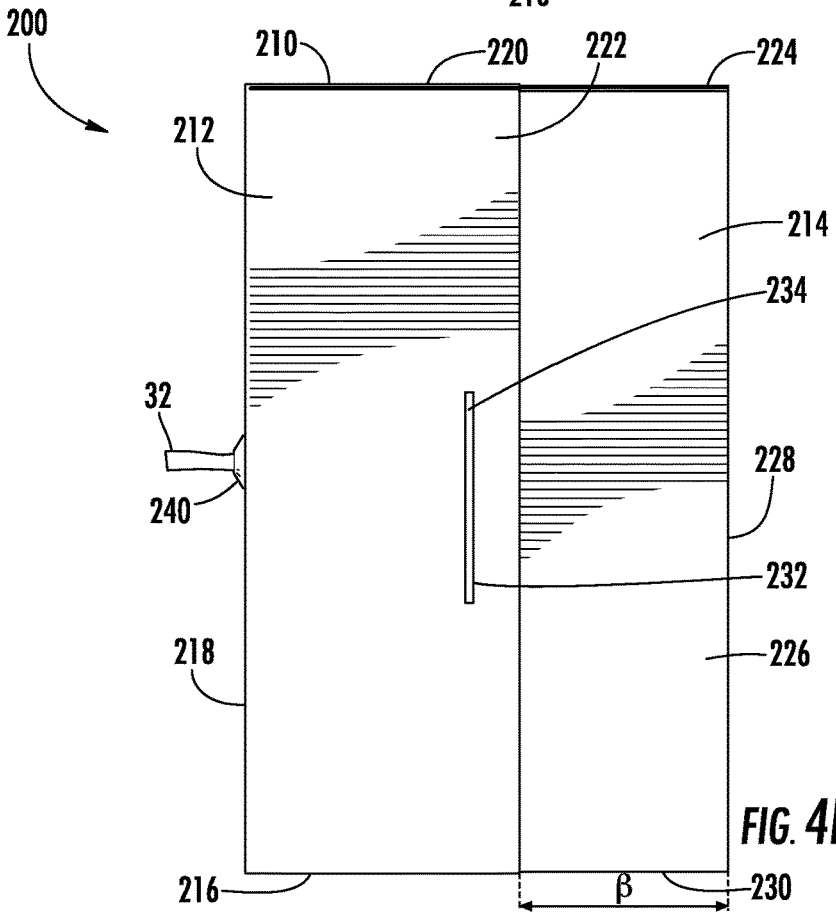
FIG. 4D is a side view of the example cutlery dispenser of FIG. 4A, showing the case in the expanded configuration.

The expandable case 210 may be configured to expand from a compact configuration, as is shown in FIGS. 4A and 4B, into an expanded configuration, as is shown in FIGS. 4C and 4D. In this manner, the compact configuration of the case 210 may define a first internal volume, and the expanded configuration of the case 210 may define a second internal volume greater than the first internal volume. In some embodiments, the case 210 may include a lid 212 and a base 214, and the lid 212 may be movable relative to the base 214 to expand the case 210 from the compact configuration into the expanded configuration. Specifically, as is shown, the lid 212 may be configured to translate (i.e., move in one direction, without rotation) relative to the base 214 to expand the case 210 from the compact configuration into the expanded configuration.

In some embodiments, the lid 212 may extend along a front of the case 210 and may translate forward relative to the base 214. According to the embodiment of FIGS. 4A-4E, the lid 212 may include a bottom wall 216, front wall 218, a top wall 220, and two side walls 222. Further, the base 214 may include a top wall 224, two side walls 226, a back wall 228, and a bottom wall 230. Other suitable structural configurations of the case 210 may be used. When the case 210 is in the compact configuration, the base 214 may be disposed within the lid 212, as is shown in FIGS. 4A and 4B, defining the first internal volume therebetween. Upon expanding the case 210 into the expanded configuration, the base 214 may remain partially disposed within the lid 212, as is shown in FIGS. 4C and 4D, defining the second internal volume therebetween. Alternatively, the lid 212 may be disposed within the base 214 when the case 210 is in the compact configuration, and the lid 212 may remain partially disposed within the base 214 when the case 210 is in the expanded configuration. In some embodiments, the lid 212 may include two slots 232 defined in the side walls 222, and the base 214 may include two mating tabs 234 extending from the side walls 226. The tabs 234 may engage the slots 232 when the case 210 is in the expanded configuration to prevent the lid 212 from translating forward further relative to the base 214. The lid 212 may translate forward a distance β relative to the back of the base 214. The distance β may be within a suitable range to provide a suitable headspace, as described herein below. In some embodiments, the distance β may be within a range of about 3 inches to about 9 inches. In some embodiments, the distance β may be about 6 inches. Other suitable distances of translating the lid 212 may be used.

Figure 4E:
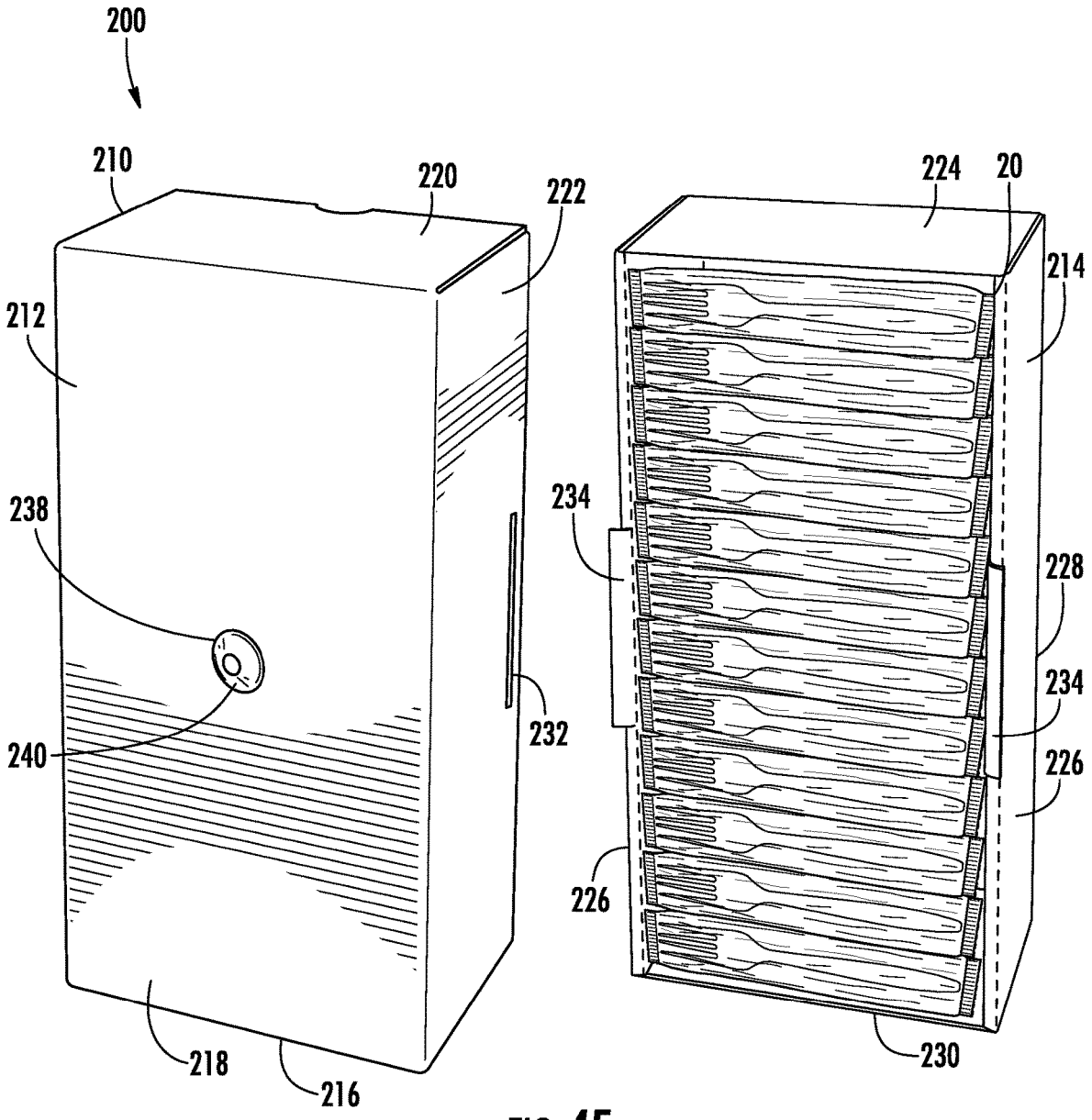
FIG. 4E is a perspective view of the example cutlery dispenser of FIG. 4A, showing the case in an open configuration.

FIG. 4E shows the cutlery dispenser 200 including the case 210 in an open configuration solely for the purpose of illustrating the wrapped cutlery band 20 disposed therein prior to being dispensed therefrom. The wrapped cutlery band 20 may be disposed within the case 210 in a serpentine or zig-zag manner such that adjacent cutlery packets 22 are folded over one another and adjacent groups of cutlery packets 22 are stacked on top of or next to one another. Alternatively, the wrapped cutlery band 20 may be disposed within the case 210 in a rolled manner such that adjacent cutlery packets 22 are rolled over one another. Other suitable configurations of disposing the band 20 within the case may be used. In some embodiments, the wrapped cutlery band 20 may substantially fill the first internal volume defined by the compact configuration of the case 210 prior to dispensing of the band 20. Upon expansion of the case 210, the expanded configuration may define a headspace between the wrapped cutlery band 20 and the top wall 224 of the base 214. Specifically, after translating the lid 212, the wrapped cutlery band 20 may settle forward and fill a lower portion of the second internal volume defined by the case 210, resulting in the headspace between the band 20 and the top wall 224. Alternatively, the wrapped cutlery band 20 may remain in place after translating the lid 212, the headspace extending between the band 20 and the front wall 218 of the lid 212. The headspace may be configured to allow the wrapped cutlery band 20 to orient within the case 210 to facilitate dispensing therefrom. In some embodiments, a height of the headspace may be greater than half of a length of the cutlery utensil 10. In some embodiments, the height of the headspace may be about the length of the cutlery utensil 10. Other suitable sizes for the height of the headspace may be used.

The case 210 may include an opening 238 defined in a wall of the case 210 and configured to allow the wrapped cutlery band 20 to be dispensed therethrough. Specifically, the opening 238 may be defined in the front wall 218 of the lid 212, as is shown. In some embodiments, the opening 238 may be configured to allow the cutlery packets 22 of the band 20 to be dispensed one at a time therethrough. The cutlery dispenser 200 also may include a nozzle 240 positioned about or within the opening 238 and configured to allow the wrapped cutlery band 20 to be dispensed therethrough. In some embodiments, the nozzle 240 may be configured to allow the cutlery packets 22 of the band 20 to be dispensed one at a time therethrough, as may be described in detail herein below with respect to FIGS. 5A-5D. As noted above, the wrapped cutlery band 20 may include a starter strip 32 positioned at the leading end 30 of the band 20. In some embodiments, as is shown, the starter strip 32 may extend through the opening 238 and the nozzle 240. In this manner, the starter strip 32 may be configured to facilitate pulling the wrapped cutlery band 20 through the opening 238 and the nozzle 240 for subsequent dispensing of the cutlery packets 22 from the cutlery dispenser 200.

In some embodiments, the case 210 may be constructed of cardboard and may be disposable. In this manner, the case 210 may be disposed of after the wrapped cutlery band 20 has been dispensed therefrom. In other embodiments, the case 210 may be constructed of a plastic and may be reusable. In this manner, after the wrapped cutlery band 20 has been dispensed from the case 210, another wrapped cutlery band 20 may be loaded into the case 210 for reuse. Other suitable materials of construction may be used for the case 210, which may be either disposable or reusable. In some embodiments, both the case 210 and the nozzle 240 may be disposable, such that the overall cutlery dispenser 200 is disposable. In this manner, the case 210 and the nozzle 240 may be disposed of after the wrapped cutlery band 20 has been dispensed.

Although the cutlery dispenser 200 may be oriented and operated in the orientation shown and described herein above with respect to FIGS. 4A-4E, the dispenser 200 also may be oriented and operated in other orientations. For example, the cutlery dispenser 200 may be oriented such that the lid 212 extends along a top of the case 210 and may translate upward relative to the base 214 into the expanded configuration. In this manner, the expanded configuration may define the headspace between the wrapped cutlery band 20 and the wall 218 of the lid 212. Based on the various possible orientations of the case 210, the adjectives "front", "back", "top", "bottom", and "side" used to describe the different walls of the case 210 may be changed to appropriately describe the respective orientations.

FIGS. 5A-5D show various steps of an example method for dispensing wrapped disposable cutlery from a cutlery dispenser in accordance with one or more embodiments of the disclosure, along with further details of the above-described cutlery dispensers. Although the method may be shown and described herein as being carried out with the cutlery dispenser 100 including the wrapped cutlery band 20, the method may be carried out in a similar manner with either the cutlery dispenser 100 or the cutlery dispenser 200 including either the wrapped cutlery band 20 or the wrapped cutlery band 40.

As described above, the expandable case 110 of the cutlery dispenser 100 may be expanded from the compact configuration defining the first internal volume into the expanded configuration defining the second internal volume greater than the first internal volume. Upon expansion of the case 110, the second configuration may define the headspace between the wrapped cutlery band 20 and the top wall 124 of the base 114 of the case 110. The headspace may allow the band 20, specifically the individual cutlery packets 22, to orient within the case 110 to facilitate dispensing therefrom. Notably, such orientation of the cutlery packets 22 may not be possible when the case 110 is in the compact configuration because the wrapped cutlery band 20 may substantially fill the first internal volume defined thereby.

Figure 5A:
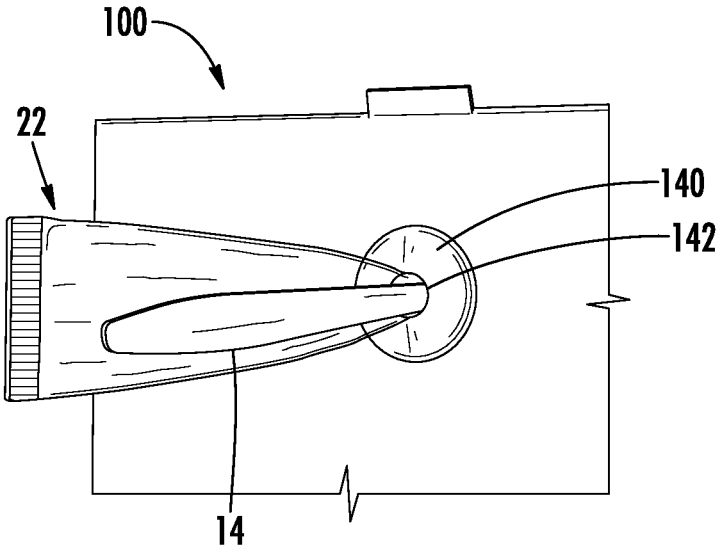
FIGS. 5A-5D are perspective views of an example method of dispensing a continuous band of wrapped disposable cutlery from a cutlery dispenser in accordance with one or more embodiments of the disclosure.

According to embodiments in which the wrapped cutlery band 20 includes the starter strip 32 positioned at the leading end 30 thereof, the starter strip 32 may be pulled through the opening 138 and the nozzle 140 until the leading end of the first cutlery packet 22 extends through the nozzle 140. The starter strip 32 then may be removed from the leading end of the first cutlery packet 22, leaving the first cutlery packet 22 ready to be dispensed from the case 110. In some embodiments, as is shown in FIG. 5A, the first cutlery packet 22 may be oriented such that the handle 14 of the cutlery utensil 10 disposed therein extends through the nozzle 140, ready to be grasped by a patron, while the head 12 remains disposed within the case 110.

As is shown, the nozzle 140 may have a frustoconical shape and may define an orifice 142 extending therethrough. The nozzle 140 may be constructed of a material configured to flex or expand. In this manner, the orifice 142 may be configured to flex or expand to allow the cutlery packets 22 of the wrapped cutlery band 20 to be dispensed therethrough. In some embodiments, the nozzle 140 may be constructed of an elastomeric material having a suitable durometer. For example, the nozzle 140 may be constructed of a rubber material having a suitable durometer. Other suitable materials of construction having a suitable durometer may be used. In some embodiments, the orifice 142 may have a circular shape, as is shown. Other suitable shapes of the orifice 142 may be used. In some embodiments, the orifice 142 may have a natural state diameter that is greater than the maximum width $W_N$ of the neck 16 of the cutlery utensil 10, less than the maximum width $W_{HA}$ of the handle 14, and less than the maximum width $W_{HE}$ of the head 12. In this manner, the orifice 142 may flex or expand as the handle 14 of the cutlery utensil 10 of the first cutlery packet 22 is pulled therethrough. The orifice 142 then may contract to its natural state diameter about the neck 16 of the cutlery utensil 10. In some embodiments, the orifice 142 may have a natural state diameter that is less than the maximum width $W_N$ of the neck 16 of the cutlery utensil 10, less than the maximum width $W_{HA}$ of the handle 14, and less than the maximum width $W_{HE}$ of the head 12. In this manner, the orifice 142 may flex or expand as the handle 14 of the cutlery utensil 10 of the first cutlery packet 22 is pulled therethrough. The orifice 142 then may contract toward, but not necessarily all the way to, its natural state diameter about the neck 16 of the cutlery utensil 10. Further, the nozzle 140 may be configured to prevent the first cutlery packet 22 from retracting into the case 110 under gravitational forces acting on the cutlery packet 22 and the remainder of the wrapped cutlery band 20. In this manner, the nozzle 140 may be configured to retain the first cutlery packet 22 within the nozzle 140 and ready to be grasped by a patron, as is shown in FIG. 5A.

Figure 5B:
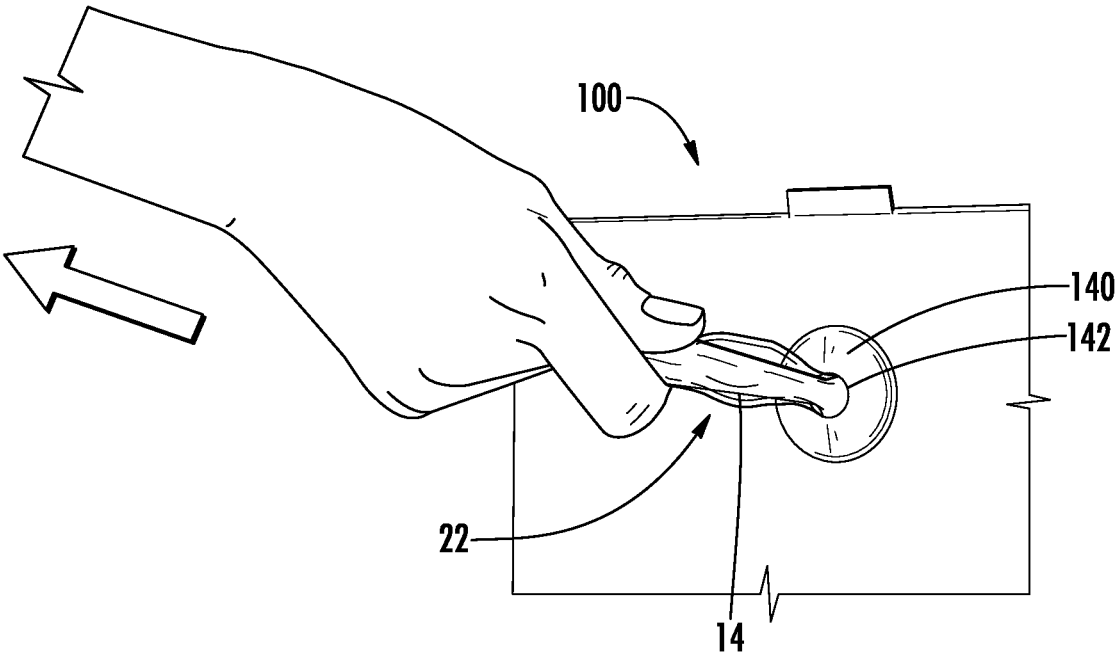

FIG. 5B shows a patron grasping the first cutlery packet 22 over the handle 14 of the cutlery utensil 10 and pulling the cutlery packet 22 away from the dispenser 100. In doing so, the orifice 142 of the nozzle 140 may flex or expand as the head 12 of the cutlery utensil 10 is pulled therethrough. The orifice 142 then may contract toward, or all the way to, its natural state diameter about the trailing end of the first cutlery packet 22.

Figure 5C:
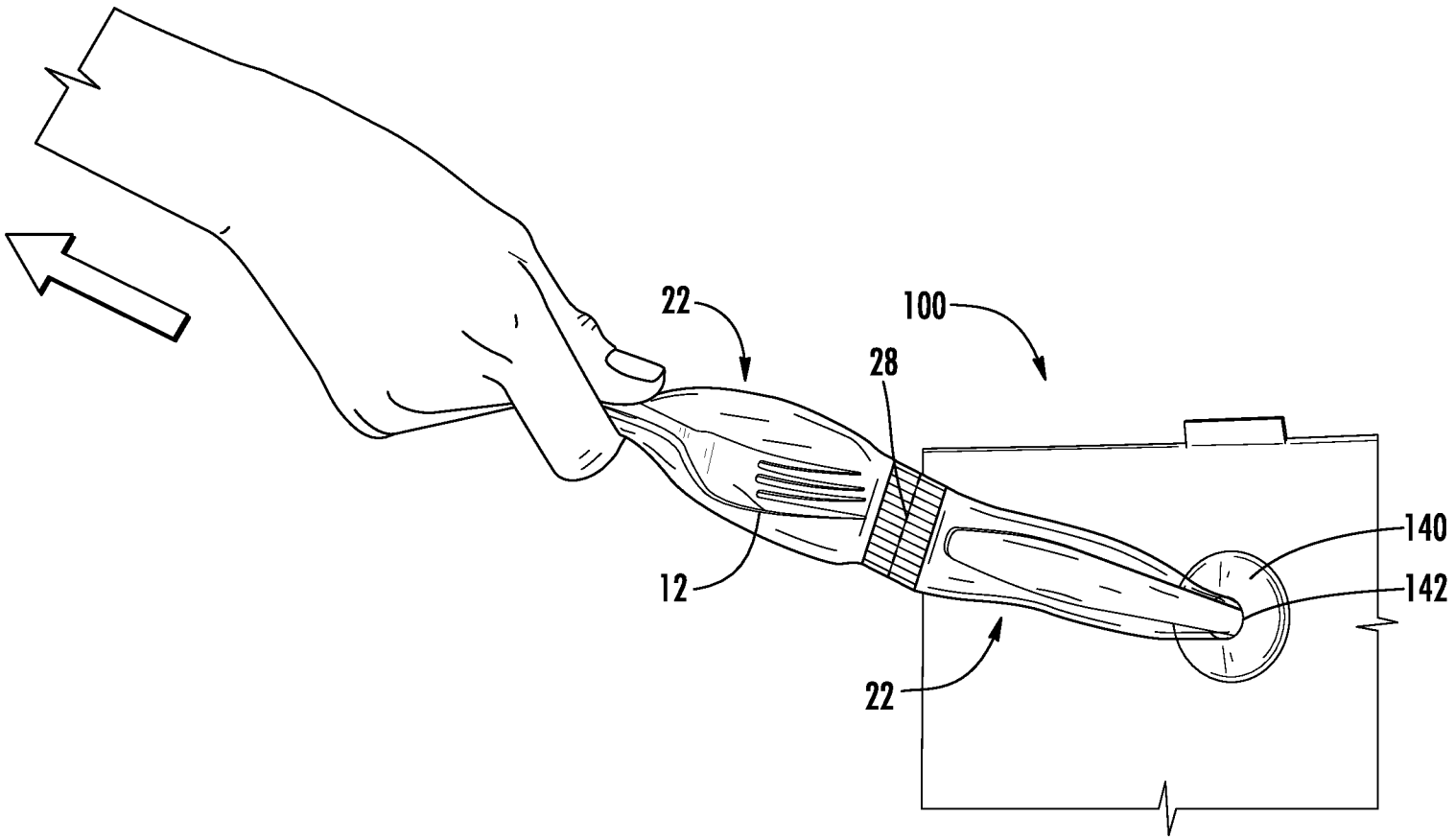

FIG. 5C shows the patron further pulling the first cutlery packet 22 away from the dispenser 100, causing the leading end of the second cutlery packet 22 to be pulled through the nozzle 140. In doing so, the orifice 142 of the nozzle 140 may flex or expand as the handle 14 of the cutlery utensil 10 of the second cutlery packet 22 is pulled therethrough. The orifice 142 then may contract toward, or all the way to, its natural state diameter about the neck 16 of the cutlery utensil 10 of the second cutlery packet 22, while the head 12 remains disposed within the case 110.

Figure 5D:
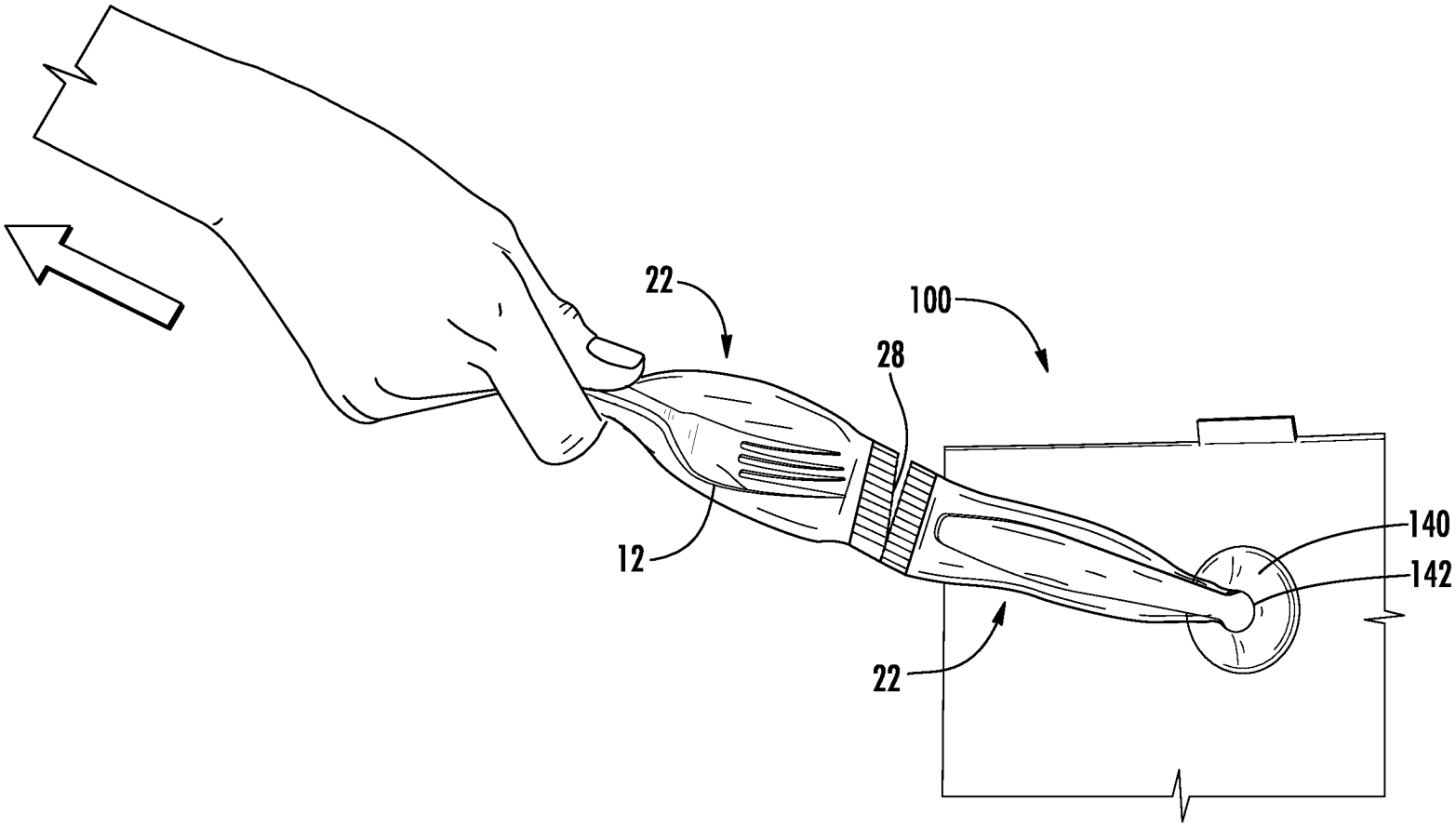

FIG. 5D shows the patron still further pulling the first cutlery packet 22 away from the dispenser 100. In doing so, a tensile force is applied to the zone of weakness 28 extending between the first and second cutlery packets 22 as the nozzle 140 resists flexion or expansion about the head 12 of the cutlery utensil 10 of the second cutlery packet 22. The zone of weakness 28 may be configured such that the tensile force required to separate the first and second cutlery packets 22 is less than the pulling force required to pull the head 12 of the cutlery utensil 10 through the nozzle 140. In other words, the nozzle 140 may be configured such that the pulling force required to pull the head 12 of the cutlery utensil 10 therethrough is greater than the tensile force required to separate the first and second cutlery packets 22. In some embodiments, the nozzle 140 may be configured such that the pulling force required to pull the head 12 of the cutlery utensil 10 therethrough is at least double the tensile force required to separate the first and second cutlery packets 22. Other suitable relationships between the values of the pulling force and the tensile force may be used. Ultimately, when the pulling force applied by the patron exceeds the required tensile force, the zone of weakness 28 may break and thus the first cutlery packet 22 may be separated from the second cutlery packet 22 for use by the patron. Meanwhile, the nozzle 140 may retain the second cutlery packet 22 within the nozzle 140 and ready to be grasped by the next patron, as is shown in FIG. 5A.

The steps of the example method described above and shown with respect to FIGS. 5A-5E may be repeated for dispensing each of the plurality of cutlery packets 22 of the wrapped cutlery band 20. As discussed above, the headspace defined by the second configuration of the case 110 may allow the cutlery packets 22 to orient within the case 110 to facilitate dispensing therefrom. Specifically, the headspace may allow the cutlery packets 22, in turn, to reorient as necessary from their respective positions in the serpentine or rolled arrangement within the case 110 to be axially aligned with the nozzle 140 for dispensing therethrough. As more cutlery packets 22 are dispensed, the headspace defined above the remainder of the wrapped cutlery band 20 may increase, which may further facilitate the orientation and dispensing of the remaining cutlery packets 22.

Although the embodiments of the example method and the example cutlery dispenser 100 described above include the tensile force being applied to the zone of weakness 28 extending between the first and second cutlery packets 22 as a result of the nozzle 140 resisting flexion or expansion about the head 12 of the cutlery utensil 10 of the second cutlery packet 22, the tensile force may be generated in other ways according to other embodiments, depending on the configuration of the cutlery utensil 10. As described above, in some embodiments, the utensil 10 may include a flange or shoulder feature that is the widest portion of the utensil 10. According to such embodiments, the tensile force may be applied to the zone of weakness 28 extending between the first and second cutlery packets 22 as the nozzle 140 resists flexion or expansion about the flange or shoulder feature of the cutlery utensil 10 of the second cutlery packet 22. Such embodiments may be particularly useful when the utensil 10 is a knife.

Although the above-described example method may be carried out with the cutlery dispenser 100 including the nozzle 140, the method also may be carried out with the cutlery dispenser 100 in the absence of the nozzle 140. In some embodiments, the opening 138 defined in the case 110 may be configured to function in a manner similar to that of the nozzle 140 described above. Specifically, the opening 138 may be configured to flex or expand to allow the cutlery packets 22 to be dispensed therethrough. Further, the opening 138 may be configured such that the pulling force required to pull the head 12 of the cutlery utensil 10 therethrough is greater than the tensile force required to separate the adjacent cutlery packets 22.

Figure 6A:
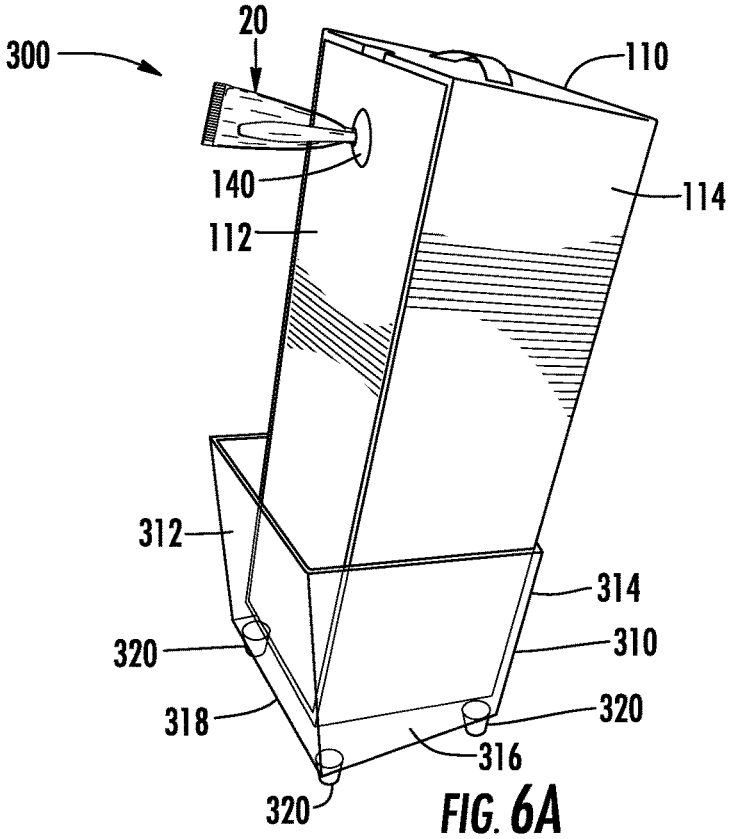
FIG. 6A is a perspective view of an example cutlery dispenser for dispensing a continuous band of wrapped disposable cutlery in accordance with one or more embodiments of the disclosure, showing a case of the dispenser in a compact configuration.
Figure 6B:
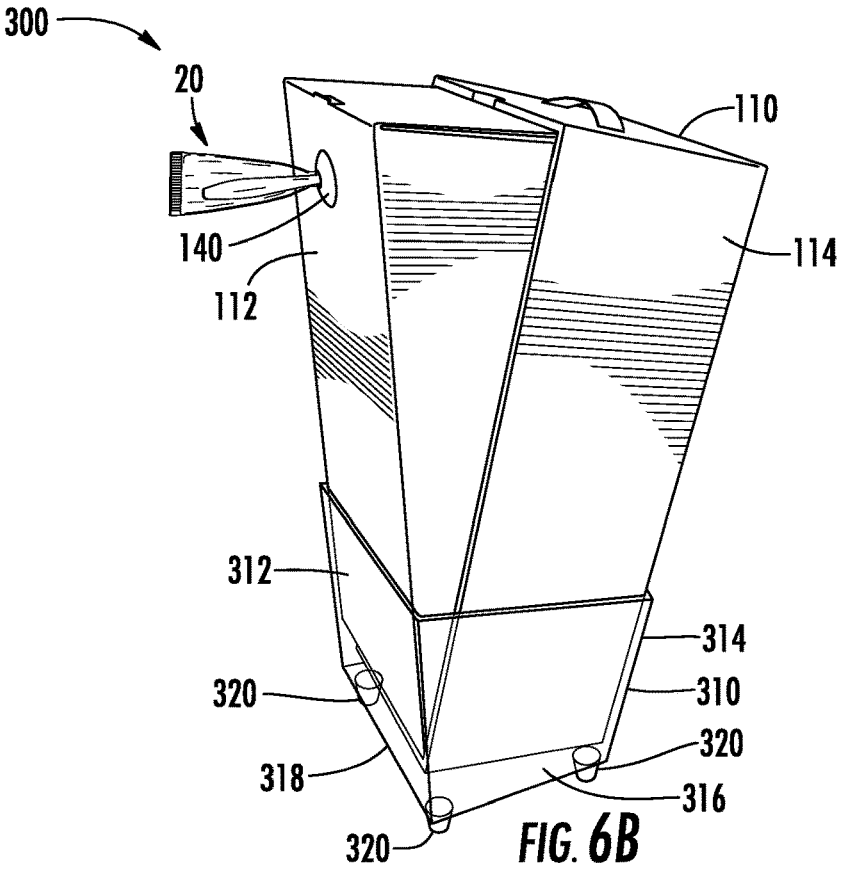
FIG. 6B is a perspective view of the example cutlery dispenser of FIG. 6A, showing the case in an expanded configuration.

FIGS. 6A and 6B show an example cutlery dispenser 300 for dispensing wrapped disposable cutlery according to one or more embodiments as may be described herein. The cutlery dispenser 300 may be generally similar to the dispenser 100 described above with respect to FIGS. 3A-3E, although certain differences may be described herein below. The cutlery dispenser 300 may include the expandable case 110 and the wrapped cutlery band 20 disposed within the case 110 and configured to be dispensed therefrom. Although the cutlery dispenser 300 may be shown and described herein as including the wrapped cutlery band 20 for dispensing therefrom, the cutlery dispenser 300 alternatively may include the wrapped cutlery band 40 for dispensing therefrom. The cutlery dispenser 300 also may include the nozzle 140. The expandable case 110, the wrapped cutlery band 20, and the nozzle 140 may be structurally and functionally configured in the manner described above with respect to FIGS. 3A-3E and 5A-5E.

The cutlery dispenser 300 further may include a stand 310 adapted to be placed on a countertop for use thereon. As is shown in FIGS. 6A and 6B, the case 110 may be at least partially disposed within the stand 310 and supported thereby. In some embodiments, the stand 310 may be configured to orient the case 110 such that the lid 112 extends in a vertical manner when the case 110 is in the expanded configuration, as is shown in FIG. 6B. The stand 310 may include a front wall 312, a back wall 314, two side walls 316, and a bottom wall 318. Other suitable structural configurations of the stand 310 may be used. In some embodiments, the front wall 312 may be configured to prevent the lid 112 from pivoting further forward relative to the base 114 when the case 110 is in the expanded configuration. In some embodiments, the nozzle 140 may be positioned on the stand 310 instead of the case 110, as described above. The stand 310 also may include a plurality of legs 320 attached to the bottom wall 318, as is shown. The legs 320 may be configured to support the stand 310 on the countertop and further may be configured to prevent the stand 310 from sliding along the surface of the countertop.

Figure 7A:
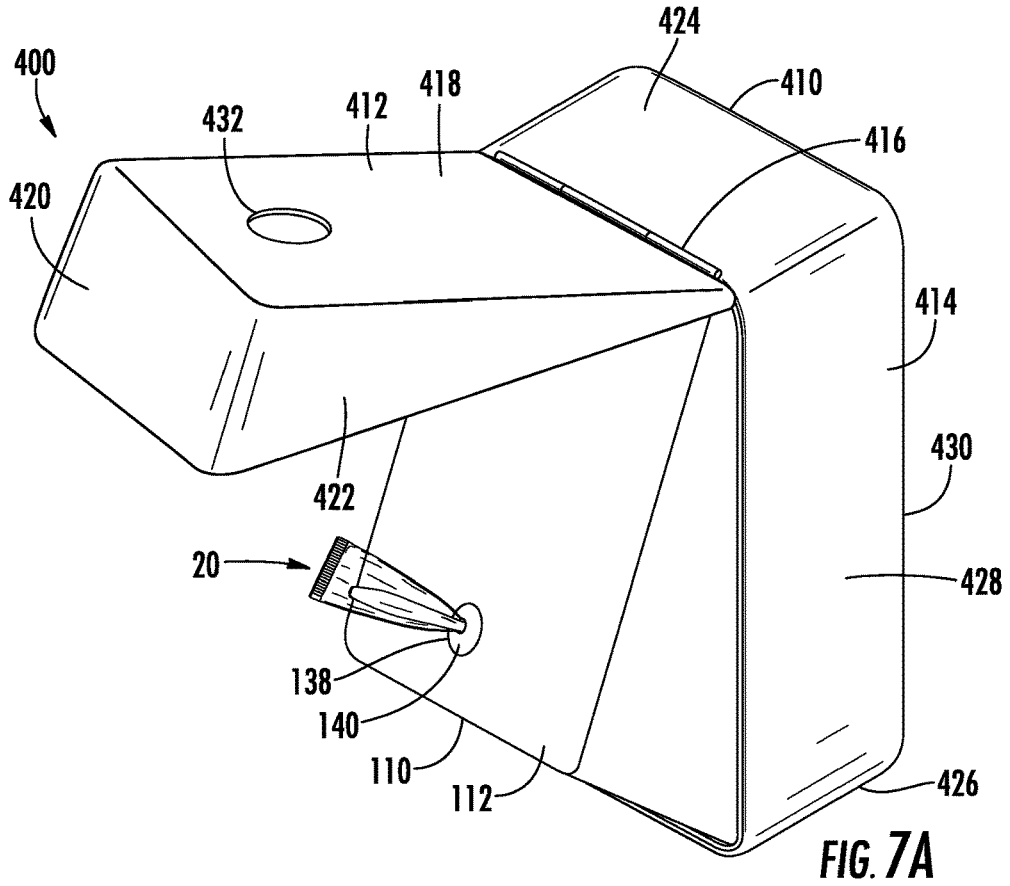
FIG. 7A is a perspective view of an example cutlery dispenser for dispensing a continuous band of wrapped disposable cutlery in accordance with one or more embodiments of the disclosure, showing a case of the dispenser in an expanded configuration and a housing of the dispenser in an open configuration.
Figure 7B:
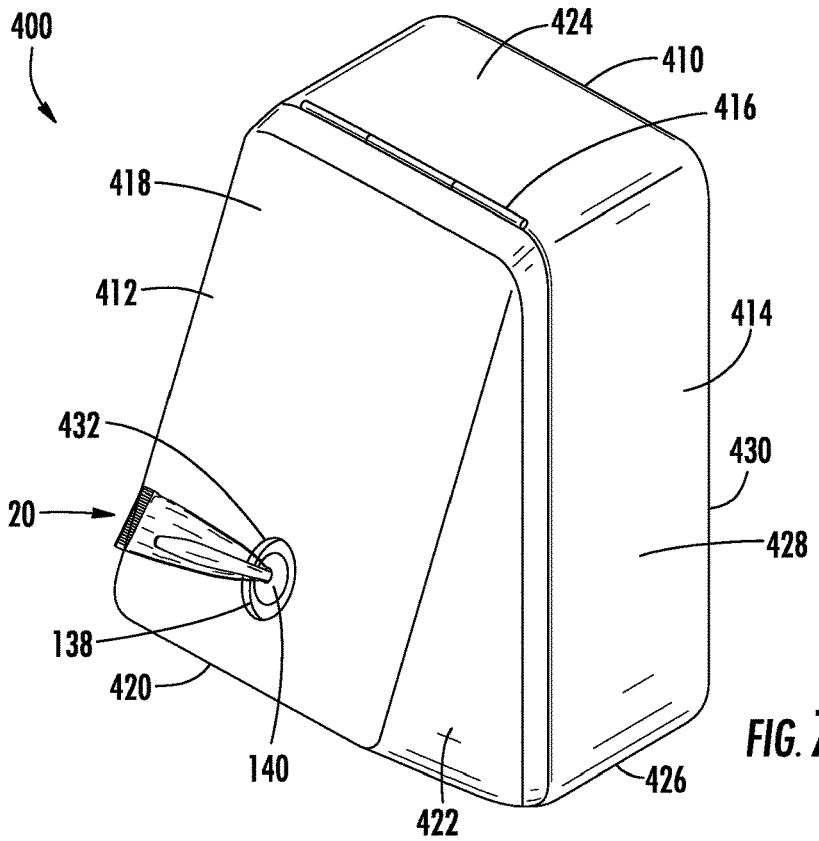
FIG. 7B is a perspective view of the example cutlery dispenser of FIG. 7A, showing the case in the expanded configuration and the housing in a closed configuration.

FIGS. 7A and 7B show an example cutlery dispenser 400 for dispensing wrapped disposable cutlery according to one or more embodiments as may be described herein. The cutlery dispenser 400 may be generally similar to the dispenser 100 described above with respect to FIGS. 3A-3E, although certain differences may be described herein below. The cutlery dispenser 400 may include the expandable case 110 and the wrapped cutlery band 20 disposed within the case 110 and configured to be dispensed therefrom. Although the cutlery dispenser 400 may be shown and described herein as including the wrapped cutlery band 20 for dispensing therefrom, the cutlery dispenser 400 alternatively may include the wrapped cutlery band 40 for dispensing therefrom. The cutlery dispenser 400 also may include the nozzle 140. The expandable case 110, the wrapped cutlery band 20, and the nozzle 140 may be structurally and functionally configured in the manner described above with respect to FIGS. 3A-3E and 5A-5E.

The cutlery dispenser 400 also may include a housing 410 adapted to be mounted on a vertical wall for use thereon. As is shown in FIGS. 7A and 7B, the case 110 may be at least partially disposed within the housing 410 and supported thereby. In some embodiments, the housing 410 may be configured to orient the case 110 such that the lid 112 extends in an angled manner when the case 110 is in the expanded configuration, as is shown. Alternatively, the housing 410 may be configured to orient the case 110 such that the lid 112 extends in a vertical manner when the case 110 is in the expanded configuration. The housing 410 may include a cover 412 and a casing 414, and the cover 412 may be pivotally connected to the casing by a hinge 416. The hinge may be positioned at a top of the housing 410 or at the bottom of the housing 410, as is shown. Accordingly, the cover 412 may be configured to pivot forward about the hinge from an open position for inserting the case 110 therein, as is shown in FIG. 7A, to a closed position for enclosing the case 110 therein, as is shown in FIG. 7B.

According to the embodiment of FIGS. 7A and 7B, the cover 412 may include a front wall 418, a bottom wall 420, and two side walls 422. Further, the casing 414 may include a top wall 424, a bottom wall 426, two side walls 428, and a back wall 430. The base 114 of the case 110 may be disposed within the casing 414, and the lid 112 of the case 110 may be disposed within the cover 412 when the case is in the expanded configuration and the cover 412 is in the closed position. The cover 412 further may include an aperture 432 defined therein and configured to allow the wrapped cutlery band 20 to be dispensed therethrough. As is shown, the aperture 432 of the cover 412 may be aligned with the opening 138 and the nozzle 140. In this manner, the housing 410 may support and protect the case 110 for dispensing of the wrapped cutlery band 20 according to the exemplary method described herein above.

The present disclosure thus provides improved cutlery dispensers and related methods for dispensing wrapped disposable cutlery to address one or more of the potential drawbacks of known dispensers and methods described above. For example, the cutlery dispensers may include a wrapped cutlery band including cutlery packets having cutlery utensils individually sealed within separate pouches to address hygiene concerns. Moreover, the dispensers may be configured to dispense the cutlery packets one at a time and in a manner such that a patron contacts only the cutlery packet dispensed for his or her use, which further facilitates hygienic dispensing. Such dispensing of the cutlery packets one at a time also may prevent patrons from unintentionally taking more than one cutlery packet.

The cutlery dispensers provided herein also may significantly reduce the time required to setup or load the dispensers for use. In some embodiments, the case of the dispenser may be used for both shipping and dispensing the wrapped cutlery band. In this manner, the dispenser may be setup merely by expanding the case from the compact configuration used for shipping into the expanded configuration used for dispensing. Due to their straightforward structural configuration, the dispensers easily may be sized for different applications appropriate for low-volume locations or high-volume locations. Further, due to the straightforward dispensing mechanisms used, which lack any moving parts, the cutlery dispensers may have a very low incidence of malfunction during dispensing of the cutlery packets. Finally, the cutlery dispensers may occupy a limited amount of space in an eating facility, as the walls of the case may be relatively thin and may merely extend around the wrapped cutlery band disposed therein in a compact arrangement. Additional improvements of the cutlery dispensers and methods provided herein will be appreciated by those of ordinary skill in the art.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific exemplary cutlery dispenser configurations, it will be appreciated that numerous other cutlery dispenser configurations are within the scope of the disclosure. Conditional language used herein, such as "can," "could," "might," or "may," unless specifically stated otherwise, or otherwise understood within the context as used, generally is intended to convey that certain embodiments could include, while other embodiments do not include, certain features, elements, or functional capabilities. Thus, such conditional language generally is not intended to imply that certain features, elements, or functional capabilities are in any way required for one or more embodiments.

I claim:

1. A cutlery dispenser for dispensing wrapped cutlery, the dispenser comprising:

a case configured to expand from a compact configuration into an expanded configuration; and a wrapped cutlery band disposed within the case and configured to be dispensed therefrom;

wherein the case comprises a base, a lid configured to translate relative to the base to expand the case from the compact configuration into the expanded configuration, and an opening defined in a wall of the case and configured to allow the wrapped cutlery band to be dispensed therethrough while the case is in the expanded configuration;

wherein the opening comprises an elastomeric nozzle therein.

2. The cutlery dispenser of claim 1, wherein the wrapped cutlery band comprises a plurality of cutlery packets separably connected to one another in a serial manner, and wherein each cutlery packet comprises a pouch and a cutlery utensil disposed within the pouch.

3. The cutlery dispenser of claim 2, wherein each cutlery packet is individually sealed by one or more seals extending along the pouch, and wherein the cutlery packets are separably connected to one another by perforated zones extending between adjacent cutlery packets.

4. The cutlery dispenser of claim 2, wherein at least a portion of the wrapped cutlery band is disposed within the case in a serpentine manner such that at least some of the cutlery packets are folded over one another.

5. The cutlery dispenser of claim 1, wherein the compact configuration defines a first internal volume, wherein the expanded configuration defines a second internal volume greater than the first internal volume, wherein the wrapped cutlery band substantially fills the first internal volume prior to being dispensed from the case, and wherein the second internal volume is enclosed by the base and the lid.

6. The cutlery dispenser of claim 1, wherein the expanded configuration defines a headspace between the wrapped cutlery band and a wall of the case, and wherein the headspace is configured to allow the wrapped cutlery band to orient within the case for dispensing from the case.

7. The cutlery dispenser of claim 6, wherein the wrapped cutlery band comprises a plurality of cutlery packets each comprising a cutlery utensil, and wherein a height of the headspace is greater than half of a length of the cutlery utensil.

8. The cutlery dispenser of claim 1, wherein a first portion of the base is disposed within the lid when the case is in the compact configuration, wherein a second portion of the base is disposed within the lid when the case is in the expanded configuration, and wherein the first portion is greater than the second portion.

9. The cutlery dispenser of claim 1, wherein the base is partially disposed within the lid when the case is in the expanded configuration.

10. The cutlery dispenser of claim 9, wherein the base comprises a first wall, a second wall attached to and oriented transverse to the first wall, a third wall attached to and oriented transverse to the first wall and positioned opposite the second wall, a fourth wall attached to and oriented transverse to the first wall, and a fifth wall attached to and oriented transverse to the first wall and positioned opposite the fourth wall, and wherein the second wall, the third wall, the fourth wall, and the fifth wall of the base each are partially disposed within the lid when the case is in the expanded configuration.

11. The cutlery dispenser of claim 10, wherein the lid comprises a first wall, a second wall attached to and oriented transverse to the first wall, a third wall attached to and oriented transverse to the first wall and positioned opposite the second wall, a fourth wall attached to and oriented transverse to the first wall, and a fifth wall attached to and oriented transverse to the first wall and positioned opposite the fourth wall, wherein the second wall, the third wall, the fourth wall, and the fifth wall of the lid each cover a portion of the base when the case is in the expanded configuration, and wherein the opening is defined in the first wall of the lid.

12. The cutlery dispenser of claim 1, wherein the case further comprises a slot and a tab configured to engage the slot when the case is in the expanded configuration and inhibit the lid from translating relative to the base.

13. The cutlery dispenser of claim 1, further comprising a nozzle disposed within the opening and configured to allow the wrapped cutlery band to be dispensed therethrough.

14. The cutlery dispenser of claim 1, wherein the opening is spaced apart from an outer periphery of the wall of the case.

15. A cutlery dispenser for dispensing wrapped cutlery, the dispenser comprising:

a case configured to contain and allow a wrapped cutlery band to be dispensed therefrom, the wrapped cutlery band comprising a plurality of cutlery packets separably connected to one another;

wherein the case is configured to expand from a compact configuration into an expanded configuration, wherein the case comprises a base, a lid configured to translate relative to the base to expand the case from the compact configuration into the expanded configuration, and an opening defined in a wall of the case and configured to allow the wrapped cutlery band to be dispensed therethrough while the case is in the expanded configuration;

wherein the opening comprises an elastomeric nozzle therein.

16. The cutlery dispenser of claim 15, wherein a first portion of the base is disposed within the lid when the case is in the compact configuration, wherein a second portion of the base is disposed within the lid when the case is in the expanded configuration, and wherein the first portion is greater than the second portion.

17. The cutlery dispenser of claim 15, wherein the opening is defined in a wall of the lid, and wherein the opening is spaced apart from an outer periphery of the wall of the lid.

* * * * *